US011424569B2

(12) United States Patent
Gondo

(10) Patent No.: US 11,424,569 B2
(45) Date of Patent: Aug. 23, 2022

(54) BOARD CONNECTOR

(71) Applicant: Molex, LLC, Lisle, IL (US)

(72) Inventor: Daishi Gondo, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 17/210,560

(22) Filed: Mar. 24, 2021

(65) Prior Publication Data

US 2021/0210890 A1 Jul. 8, 2021

Related U.S. Application Data

(63) Continuation of application No. 16/993,263, filed on Aug. 14, 2020, now Pat. No. 10,985,491, which is a (Continued)

(30) Foreign Application Priority Data

Aug. 22, 2018 (JP) ..... JP2018-155276

(51) Int. Cl.
*H01R 13/508* (2006.01)
*H01R 12/71* (2011.01)
*H01R 13/41* (2006.01)

(52) U.S. Cl.
CPC ..... *H01R 13/508* (2013.01); *H01R 12/716* (2013.01); *H01R 13/41* (2013.01)

(58) Field of Classification Search
CPC .... H01R 12/707; H01R 13/502; H01R 13/03; H01R 13/40; H01R 13/405
See application file for complete search history.

(56) References Cited

U.S. PATENT DOCUMENTS 7,059,908 B2 * 6/2006 Yamaguchi ..... H01R 13/6583 439/607.17
7,568,919 B2 8/2009 Hoshino et al.
(Continued)

FOREIGN PATENT DOCUMENTS

CN 102629713 A 8/2012
CN 103682710 A 3/2014
(Continued)

OTHER PUBLICATIONS

Notice of Allowance received for KR application No. 10-2019-0102207, dated Dec. 21, 2020, 2 pages. (1 page of English translation).

(Continued)

*Primary Examiner* — Jean F Duverne

(57) ABSTRACT

The present disclosure includes: a pair of left and right half body parts, each of which includes a connector main body along with multiple terminals installed in this connector main body; and a reinforcing bracket for coupling the half body parts, wherein connector main bodies of each of the half body parts are abutted and installed at main body end parts formed on both ends of the connector main bodies, wherein each connector main body extends in the longitudinal direction thereof, in addition to including a projection for retaining the terminals, an extension end part connected to both ends in the longitudinal direction of this projection, and an end wall part extending from this extension end part towards the counterpart half body part, and wherein each of the main body end parts include mutually abutted left and right end wall parts along with left and right extension end parts with these end wall parts extending therefrom.

21 Claims, 16 Drawing Sheets

Related U.S. Application Data continuation of application No. 16/522,647, filed on Jul. 26, 2019, now Pat. No. 10,784,616.

(56) References Cited

U.S. PATENT DOCUMENTS

| | | | | |
|---|---|---|---|---|
| 8,087,942 | B2 | 1/2012 | Chen | |
| 8,858,239 | B2 | 10/2014 | Little et al. | |
| 9,124,011 | B2 | 9/2015 | Miyazaki et al. | |
| 9,190,750 | B2 * | 11/2015 | Takeuchi | H01R 12/716 |
| 9,350,095 | B2 | 5/2016 | Arichika et al. | |
| 9,484,648 | B2 | 11/2016 | Takenaga et al. | |
| 9,537,244 | B2 | 1/2017 | Miyazaki et al. | |
| 9,543,675 | B1 | 1/2017 | Takenaga et al. | |
| 2015/0079816 | A1 * | 3/2015 | Suzuki | H01R 12/7082 439/74 |
| 2020/0067227 | A1 | 2/2020 | Gondo | |

FOREIGN PATENT DOCUMENTS

| | | | |
|---|---|---|---|
| CN | 204118348 | U | 1/2015 |
| CN | 106356656 | A | 1/2017 |
| CN | 107181076 | A | 9/2017 |
| CN | 107453076 | A | 12/2017 |
| CN | 107799938 | A | 3/2018 |
| CN | 207426302 | U | 5/2018 |
| JP | H1140283 | A | 2/1999 |
| JP | 2001503187 | A | 3/2001 |
| JP | 2001126789 | A | 5/2001 |
| JP | 3368471 | B2 | 1/2003 |
| JP | 4685156 | B2 | 5/2011 |
| JP | 6174005 | B2 | 8/2017 |
| KR | 100263597 | B1 | 8/2000 |
| KR | 101552941 | B1 | 9/2015 |

OTHER PUBLICATIONS

Non-Final rejection received for U.S. Appl. No. 16/522,647, dated Mar. 5, 2020, 6 pages.

Office Action received for JP Application No. 2018-155276, dated Feb. 22, 2022, 08 Pages (04 Pages of English Translation and 04 Pages of Official notification).

* cited by examiner

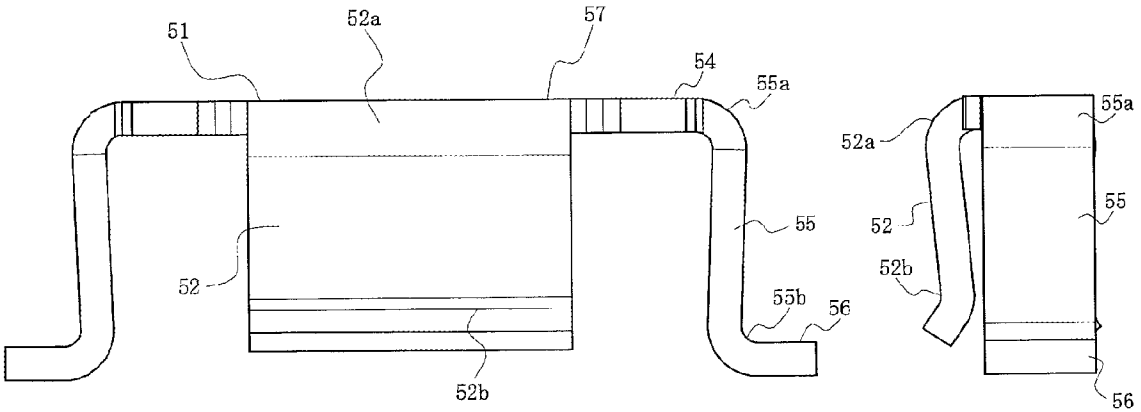
FIG. 5A
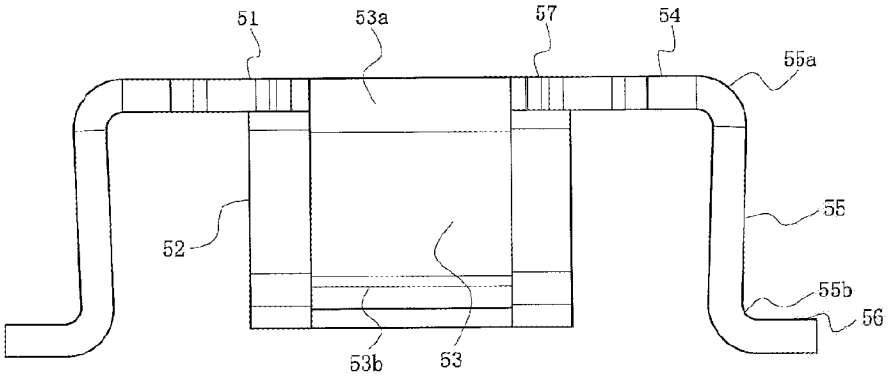
FIG. 5B
FIG. 5C

BOARD CONNECTOR

RELATED APPLICATIONS

This application is a continuation of U.S. patent application Ser. No. 16/993,263, filed on Aug. 14, 2020, which is a continuation of U.S. patent application Ser. No. 16/522,647, filed on Jul. 26, 2019, which claims priority to Japanese Application No, 2018-155276, filed on Aug. 22, 2018. Each of the aforementioned applications are incorporated herein by reference in their entireties.

TECHNICAL FIELD

The present disclosure relates to a connector.

BACKGROUND ART

Conventionally, connectors such as board to board connectors, etc., have been used to electrically connect pairs of parallel circuit boards together. These types of connectors are attached to mutually facing surfaces on pairs of circuit boards and provide conduction when mated together for example see Patent Document 1.

FIG. 16 is a perspective view illustrating a conventional connector.

In the drawing, 811 is a connector housing mounted on a circuit board (not illustrated) having a pair of elongated projections 812 which extend in the longitudinal direction thereof. Multiple terminals 861 are installed on these projections 812 in parallel in the longitudinal direction of the connector.

Furthermore, when the connector is mated with the counterpart connector, the projections 812 are inserted into each of a pair of recessed grooves formed in the counterpart housing of the counterpart connector. Thus, the terminals 861 connect to the respective counterpart terminals (not illustrated) installed in the recessed groove allowing conduction.

Patent Document: Patent Document 1: JP 2001-126789 A

SUMMARY

Unfortunately, with conventional connectors, because the terminals 861 are formed so as to be integrated with the housing 811, if the size is reduced, the interval between projections 812 narrows, reducing the pitch of the terminals 861 and making the connector more difficult to manufacture. Normally, the terminals 861 are integrated with a pair of projections 812 of the housing 811 using a molding method referred to as overmolding or insert molding. Therefore, if the interval between projections 812 narrows and the pitch of the terminals 861 is reduced, accurate placing of multiple terminals 861 positioned corresponding to the pair of projections 812 in a metal mold for molding the housing 811 becomes difficult.

Here, the objective is to resolve the problems of conventional connectors, enabling narrowing of the interval between projections for installing multiple terminals and therefore size reduction, and providing a connector with high reliability.

Therefore, the connector includes: a pair of left and right half body parts, each of which includes a connector main body along with multiple terminals installed on this connector main body; and a reinforcing bracket for coupling the half body parts, wherein connector main bodies of each of the half body parts are abutted and installed at main body end parts formed on both ends of the connector main bodies, wherein each connector main body extends in the longitudinal direction thereof, in addition to including a projection for retaining the terminals, an extension end part connected to both ends in the longitudinal direction of this projection, and an end wall part extending from this extension end part towards the counterpart half body part, and wherein each of the main body end parts include mutually abutted left and right end wall parts along with left and right extension end parts with these end wall parts extending therefrom.

In another connector, the reinforcing bracket includes: an upper plate extending in the width direction of the connector main body; a pair of end wall holding plates which are connected to both side edges of this upper plate so as to hold the end wall part; and a pair of extension end holding plates which are connected to both ends of the upper plate so as to hold the extension end part.

In yet another connector, the upper plate includes: an end wall upper surface covering part facing the upper surface of the end wall part; and a protruding end upper surface covering part which is connected to both ends of this end wall upper surface covering part so as to face the upper surface of the extension end part, while the end wall holding plate includes an end wall outer surface covering part and an end wall inner surface covering part which face the outer and inner surfaces of the end wall part, and the extension end holding plate includes a leg part which is connected to the outer end of the protruding end upper surface covering part so as to face the outer surface of the extension end part.

Further, in yet another connector, the end wall part includes a thick part along with a thin part connected to the lower side of this thick part, while the extension end part includes a thick part along with a thin part connected to the lower side of this thick part, wherein, in the reinforcing bracket prior to the installation thereof to the main body end parts, the interval between the nearest parts of the end wall holding plates is narrower than the interval between the outer and inner surfaces at the location corresponding to the thick part of the end wall part, while the interval between the nearest parts of the extension end holding plates is narrower than the interval between the outer surfaces at the location corresponding to the thick part of the extension end part.

Further, in yet another connector, the outer surface of the end wall part includes a step between an outer projection surface corresponding to the thick part and an outer recessed surface corresponding to the thin part, while the inner surface of the end wall part includes a step between an inner projection surface corresponding to the thick part and an inner recessed surface corresponding to the thin part, and the outer surface of the extension end part includes a step between the outer projection surface corresponding to the thick part and the outer recessed surface corresponding to the thin part.

Further, in yet another connector, the reinforcing bracket is a locking protrusion which is formed in the end wall outer surface covering part, the end wall inner surface covering part, and the leg part and engages with the step.

Further, in yet another connector, the upper surface of the end wall part and the upper surface of the extension end part are recessed from the upper surface of the projection, the outer surface of the end wall part is recessed from the end surface of the extension end part, the inner surface of the end wall part is recessed from an end wall base inner surface, the outer surface of the extension end part is recessed from the outer surface of the projection, the upper plate does not protrude from the upper surface of the projection, the end wall holding plate does not protrude from an exposed side face of the main body end part, and the extension end holding plate does not protrude from the outer surface of the projection.

A connector pair according to the present disclosure includes: the connector; and a counterpart connector mating with the connector.

In this disclosure, the interval between projections at which the multiple terminals are installed can be narrowed, simplifying manufacturing, reducing size, and improving reliability.

BRIEF DESCRIPTION OF DRAWINGS

FIGS. 2A-2C are three-face views of the first connector according to Embodiment 1, wherein FIG. 2A is a top view, FIG. 2B is a side view, and FIG. 2C is a bottom view.

FIGS. 5A-5C are first three-face views of a first reinforcing bracket according to Embodiment 1, wherein FIG. 5A is a front view, FIG. 5B is a rear view, and FIG. 5C is a side view.

FIGS. 6A-6C are second three-face views of the first reinforcing bracket according to Embodiment 1, wherein FIG. 6A is top view, FIG. 6B is a cross sectional view in the arrow direction along line A-A in FIG. 6A, and FIG. 6C is a cross sectional view in the arrow direction along line B-B in FIG. 6A.

FIGS. 7A-7B are two-face views of a pair of mutually abutted half parts according to Embodiment 1, wherein FIG. 7A is a perspective view, while FIG. 7B is a top view.

FIGS. 8A-8B are cross sectional views of the main parts of a pair of mutually abutted half parts according to Embodiment 1, wherein FIG. 8A is a cross sectional view in the arrow direction along line C-C in FIG. 7B, while FIG. 8B is a cross sectional view in the arrow direction along line D-D in FIG. 7B.

FIGS. 10A-10B are cross sectional views of the main parts illustrating the state immediately before coupling the pair of mutually abutted half parts according to Embodiment 1 with the first reinforcing bracket, wherein FIG. 10A is a cross sectional view in the arrow direction along line E-E in FIG. 9, while FIG. 10B is a cross sectional view in the arrow direction along line F-F in FIG. 9.

FIGS. 14A-14C are first three-face views of the first reinforcing bracket according to Embodiment 2, wherein FIG. 14A is a front view, FIG. 14B is a rear view, and FIG. 14C is a side view.

FIGS. 15A-15C are second three-face views of the first reinforcing bracket according to Embodiment 2, wherein FIG. 15A is top view, FIG. 15B is a cross sectional view in the arrow direction along line G-G in FIG. 15A, and FIG. 15C is a cross sectional view in the arrow direction along line H-H in FIG. 15A.

DETAILED DESCRIPTION OF THE PREFERRED EMBODIMENTS

An embodiment will be described in detail below with reference to the drawings.

Figure 1:
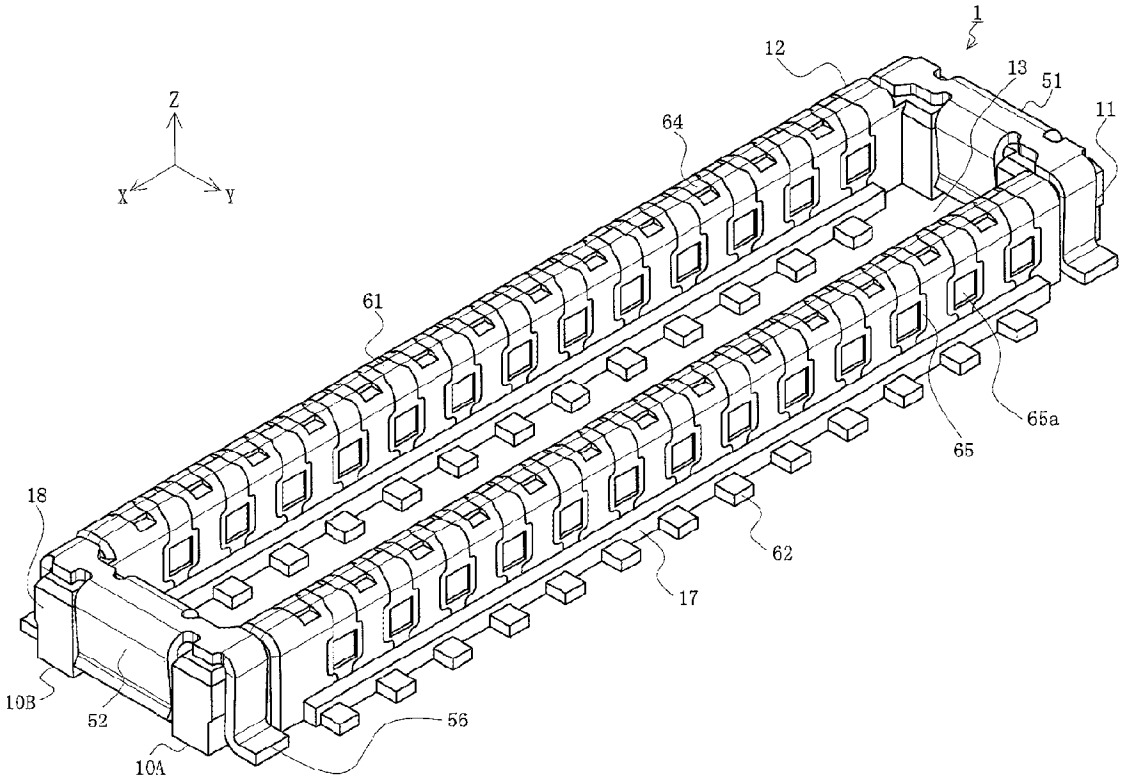
FIG. 1 is a perspective view of a first connector according to Embodiment 1.
Figures 2A, 2B, 2C:
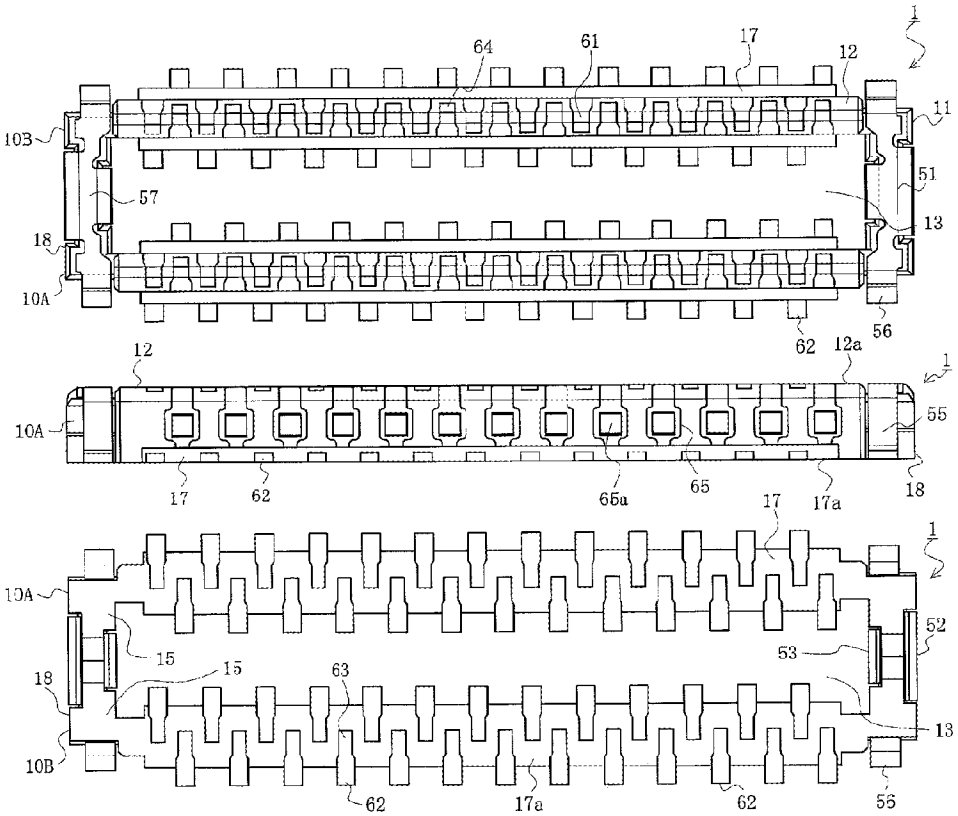
Figure 3:
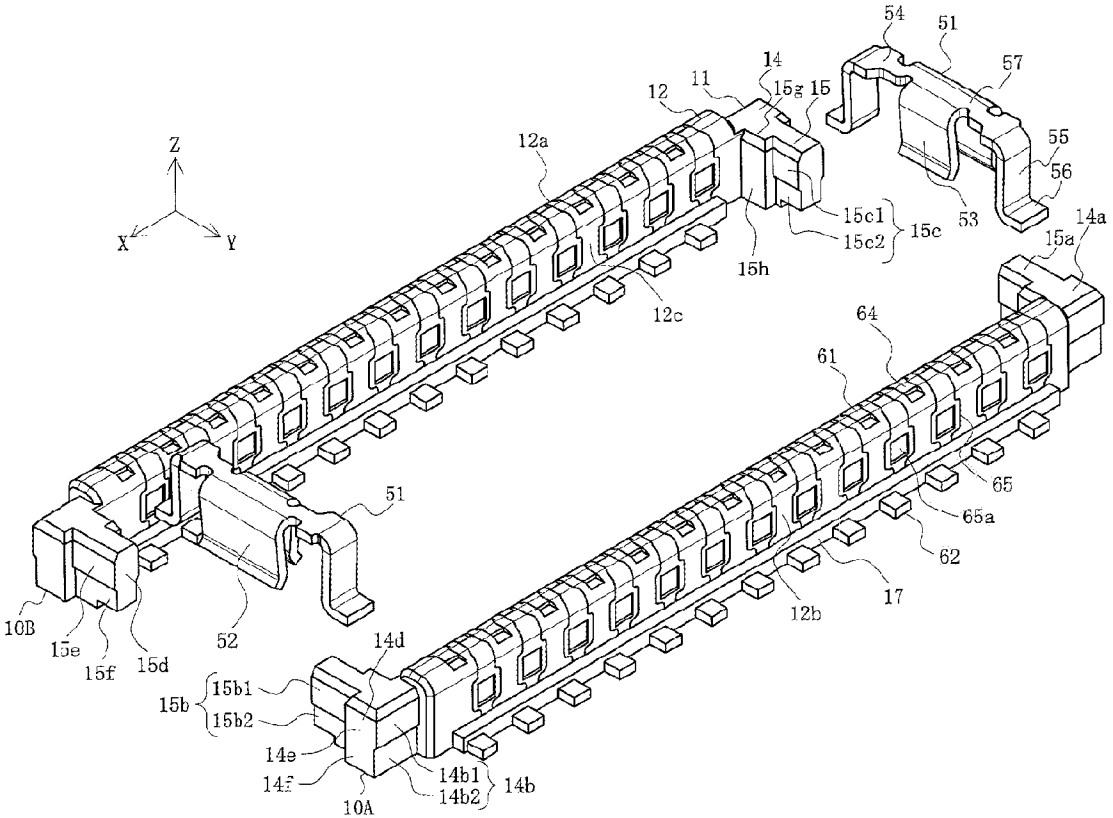
FIG. 3 is a first exploded view of the first connector according to Embodiment 1.
Figure 4:
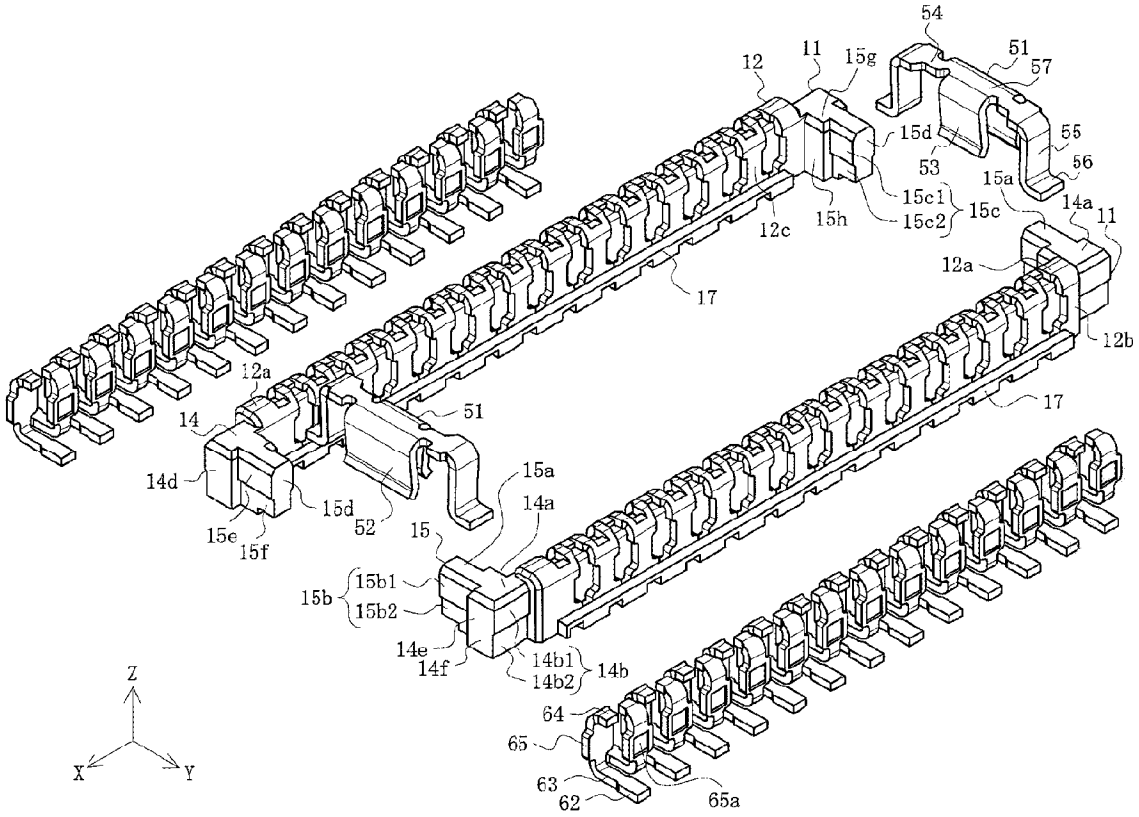
FIG. 4 is a second exploded view of the first connector according to Embodiment 1.
Figure 6A:
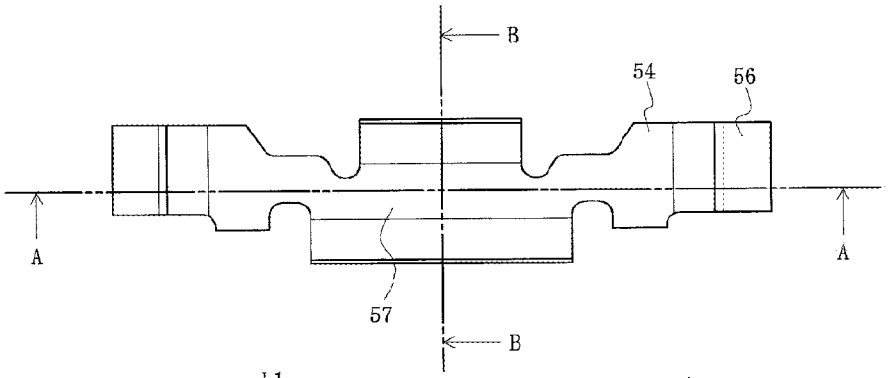
Figure 6B:
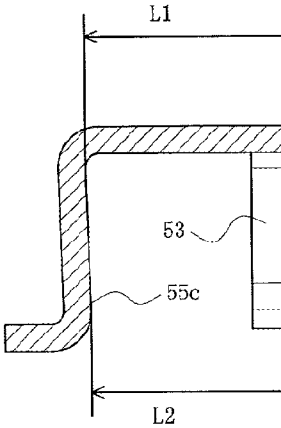
Figure 6C:
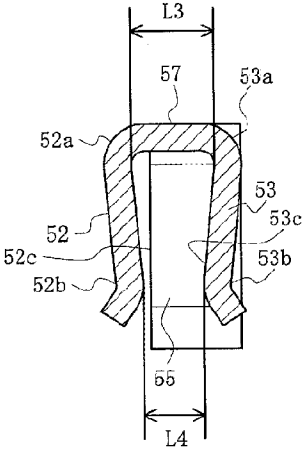

FIG. 1 is a perspective view of a first connector according to Embodiment 1, FIGS. 2A-2C are three-face views of the first connector according to Embodiment 1, FIG. 3 is a first exploded view of the first connector according to Embodiment 1, FIG. 4 is a second exploded view of the first connector according to Embodiment 1, FIGS. 5A-5C are first three-face views of a first reinforcing bracket according to Embodiment 1, and FIGS. 6A-6C are second three-face views of the first reinforcing bracket according to Embodiment 1. Note that in FIGS. 2A-2C, FIG. 2A is a top view, FIG. 2B is a side view, and FIG. 2C is a bottom view, while in FIGS. 5A-5C, FIG. 5A is a front view, FIG. 5B is a rear view, and FIG. 5C is a side view, and in FIGS. 6A-6C, FIG. 6A is top view, FIG. 6B is a cross sectional view in the arrow direction along line A-A in FIG. 6A, and FIG. 6C is a cross sectional view in the arrow direction along line B-B in FIG. 6A.

In the figures, 1 is a connector of the present embodiment and is the first connector serving as one of a pair of board to board connectors. The first connector 1 is a surface mount type connector mounted on the surface of a first substrate (not illustrated) that serves as a mounting member and is mated to a second connector 101 that serves as the below-mentioned counterpart connector. Furthermore, the second connector 101 is the other of the pair of board to board connectors and is a surface mount type connector mounted on the surface of a second substrate (not illustrated) that serves as a mounting member.

Note that while the first connector 1 and the second connector 101 are ideally used for electrically connecting the first substrate and the second substrate serving as substrates, the connectors can also be used to electrically connect other members. Examples of the first substrate and the second substrate include printed circuit boards, flexible flat cables (FFC), flexible printed circuit boards (FPC), etc. used in electronic equipment, etc., but may be any type of substrate.

Furthermore, expressions indicating directions such as up, down, left, right, front, and back used to describe the operations and configurations of the parts of the first connector 1 and the second connector 101 in the present embodiment are not absolute but rather relative directions, and though appropriate when the parts of the first connector 1 and the second connector 101 are in the positions illustrated in the figures, these directions should be interpreted differently when these positions change in order to correspond to said change.

In addition, the first connector 1 is configured by coupling a pair of left and right half body parts, that is, a left half body part 10A and a right half body part 10B, via a first reinforcing bracket 51 as a reinforcing bracket. Note that the left half body part 10A and the right half body part 10B are identical members which are disposed so as to laterally face each other and are described as a half body part 10 for comprehensive description. The shapes of the respective left half body part 10A and right half body part 10B in the plan view (shape projected onto the X-Y surface) are a frame shape, while the space between the left half body part 10A and right half body part 10B is an elongated recessed groove part 13 extending in the longitudinal direction (X axis direction) of the first connector 1. This recessed groove part 13 is a penetrating hole opened in the upper surface and lower surface of the first connector 1.

The half body part 10 is formed so as to be integrated with an insulating material such as a synthetic resin or the like and has a first housing 11 as a connector body having a frame shape in a plan view. Each first housing 11 includes: an elongated band shaped bottom plate part 17 extending in the longitudinal direction (X-axis direction) of this first housing 11; and a first projection 12 as an elongated projection extending in the longitudinal direction of the first housing 11 integrally formed on the upper surface of the bottom plate 17. The first projection 12 is a member in which the shape of the cross section is similar to an upside-down U and has a curved mating surface 12*a* positioned on the top (positive direction on Z axis) along with an outer surface 12*b* and an inner surface 12*c* connected to both the left and right sides of this mating surface 12*a*. The outer surface 12*b* and the inner surface 12*c* are a pair of flat surfaces which face each other in parallel and extend in the longitudinal direction of the first housing 11. Note that because the dimensions of the first projection 12 in the width direction (Y-axis direction) are shorter than the dimensions of the bottom plate part 17 in the width direction, the bottom plate part 17 protrudes externally in the width direction from the outer surface 12*b* and the inner surface 12*c*, at the lower end (end towards negative Z-axis direction) of the first projection 12. Moreover, the lower surface of the bottom plate part 17 is a mounting surface 17*a* of the first housing 11 facing the surface of the first substrate.

In addition, a first terminal 61 is arranged in each first projection 12 as a terminal. The first terminals 61 are arranged at a prescribed pitch and in multiple pieces (26 pieces in the example illustrated in the figure). The first terminal 61 is a member integrally formed through punching or bending a conductive metal plate and includes a main body part 63 extending in the width direction of the first projection 12, a tail part 62 connected to one end of the main body part 63, a connecting part 65 bent nearly 90 degrees and extending in the vertical direction connected to the other end of the main body part 63, and an upper end part 64 bent by 90 degrees and connected to the upper end of the connecting part 65.

The main body part 63 is the part embedded and retained in the bottom plate part 17. In addition, the tail part 62 extends externally from the bottom plate part 17 in the width direction and is connected via soldering or the like to a connection pad that is coupled to the conductive trace on the first substrate. Note that the conductive trace is typically a signal line. Furthermore, when the first connector 1 and second connector 101 mate, the contact part 65 is the part that contacts the second terminal 161 described below provided on the second connector 101 and preferably includes a contact recess 65*a* recessed from the surface.

First terminal 61 is integrated with first housing 11 by a molding method referred to as overmolding or insert molding. That is, first housing 11 is molded by filling the cavity of a mold, in which first terminal 61 has been set beforehand, with an insulating material. Thus, the first terminal 61 is integrally installed on the first housing 11 with the bottom surface of the main body part 63 and tail part 62 exposed to the mounting surface 17*a* of the bottom plate part 17 and with the surface of the contact part 65 and upper end part 64 exposed to the outer surface 12*b* or inner surface 12*c* and mating surface 12*a* of the first projection 12.

Furthermore, the first terminal 61 installed on each first projection 12 is oriented such that the posture of adjacent objects face opposite to the width direction of the first projection 12. Regarding the example illustrated in FIG. 4, the posture of the first terminal 61 positioned on the front end (end in the positive x-axis direction) of the first terminal 61 installed on the first projection 12 of the left half body part 10A is oriented such that the tail part 62 protrudes externally (towards the positive y-axis direction), and in contrast, the posture of the first terminal 61 positioned second from the front end is oriented such that the tail part 62 protrudes internally (towards the negative y-axis direction). In this manner, as the first terminals 61 are installed on the first projection 12 arranged in a line in alternating directions, the pitch of the tail parts 62 protruding from each side of that first projection 12 are double that of the pitch of the first terminal 61. Therefore, connection work by soldering and the like to the connection pad of the first substrate can easily be performed. In addition, the pitch of the contact part 65 exposed on the outer surface 12*b* of the first projection 12 and the pitch of the contact part 65 exposed on the inner surface 12*c* are also double that of the pitch of the first terminal 61.

Furthermore, as the first terminal 61 is a member that will be integrated into a first housing 11 by a molding method referred to as overmolding or insert molding, it is not meant to exist apart from the first housing 11; however, note that it is drawn such that it appears apart from the first housing 11 in FIG. 4 for convenience of description.

In addition, a first protruding end part 18 that is a main body end part that functions as a mating guide part is respectively disposed on both ends in the longitudinal direction of the first projection 12. This first protruding end part 18 is a member connected to both ends in the longitudinal direction of each first projection 12, and is formed with the left half body part 10A and the right half body part 10B abutted, that is, with left and right first housings 11 abutted. In addition, in the state in which the first connector 1 and the second connector 101 are mated, the first protruding end part 18 functions as an insertion projection inserted into the mating recess 122 of the second protrusion end part 121 described below provided on the first connector 101. Moreover, the first reinforcing bracket 51 is installed at the first protruding end part 18.

Moreover, the first protruding end part 18 is configured by an extension end part 14 and an end wall part 15 of left and right half body parts 10. Each extension end part 14 extending in the longitudinal direction is integrally connected at both ends in the longitudinal direction of the first projection 12 of each half body part 10, while each end wall part 15 extending in the width direction of the first projection 12 is integrally connected to each extension end part 14. Note that the end wall part 15 in the left half body part 10A extends in the right direction (negative Y-axis direction), while the end wall part 15 in the right half body part 10B extends in the left direction (positive Y-axis direction). In each half body part 10 disposed so as to laterally face each other, the end wall part 15 extends towards the counterpart half body part 10. In addition, the end surface facing the counterpart half body part 10 in the end wall part 15 functions as a coupling surface 15*d*.

Each extension end part 14 includes a thick part 14*e* having a large width, that is, a large thickness (large dimension in the Y-axis direction), along with a thin part 14*f* having a smaller thickness (small dimension in the Y-axis direction) which is connected to the lower side (towards the negative Z-axis direction) of this thick part 14*e*. In addition, the outer surface 14*b* of the extension end part 14 includes an outer projection surface 14*b*1 corresponding to the thick part 14*e*, along with an outer recessed surface 14*b*2 corresponding to the thin part 14*f*. This outer recessed surface 14*b*2 is recessed so as to be disposed more internally in the width direction (Y-axis direction) of the first housing 11 than the outer projection surface 14*b*1. Because the entire outer surface 14*b* of the extension end part 14 is recessed so as to be disposed more internally in the width direction of the first housing 11 than the outer surface 12*b* of the first projection 12, the outer projection surface 14*b*1 is also recessed so as to be disposed more internally in the width direction of the first housing 11 than the outer surface 12*b* of the first projection 12.

Moreover, each end wall part 15 includes a thick part 15*e* having a large width, that is, a large thickness (large dimension in the X-axis direction), along with a thin part 15*f* having a smaller thickness (small dimension in the X-axis direction) which is connected to the lower side of this thick part 15*e*. In addition, the outer surface 15*b* of the end wall part 15 includes an outer projection surface 15*b*1 corresponding to the thick part 15*e*, along with an outer recessed surface 15*b*2 corresponding to the thin part 15*f*. This outer recessed surface 15*b*2 is recessed so as to be disposed more internally in the longitudinal direction (X-axis direction) of the first housing 11 than the outer projection surface 15*b*1. Because the entire outer surface 15*b* of the end wall part 15 is recessed so as to be disposed more internally in the longitudinal direction of the first housing 11 than the end surface 14*d* of the extension end part 14, the outer projection surface 15*b*1 is also recessed so as to be disposed more internally in the longitudinal direction of the first housing 11 than the end surface 14*d* of the extension end part 14.

Furthermore, each end wall part 15 includes an inner end part 15*g* which protrudes internally in the longitudinal direction of the first housing 11 in the vicinity of a connecting part to the extension end part 14. An end wall base inner surface 15*h* serving as the inner surface of this inner end part 15*g* is the surface exposed to the recessed groove part 13, in addition to also being a flat surface extending in the vertical direction (Z-axis direction). In addition, the inner surface 15*c* of the end wall part 15 includes an inner projection surface 15*c*1 corresponding to the thick part 15*e*, along with an inner recessed surface 15*c*2 corresponding to the thin part 15*f*. This inner recessed surface 15*c*2 is recessed so as to be disposed more externally in the longitudinal direction of the first housing 11 than the inner projection surface 15*c*1. Because the entire inner surface 15*c* of the end wall part 15 is recessed so as to be disposed more externally in the longitudinal direction of the first housing 11 than the end wall base inner surface 15*h*, the inner projection surface 15*c*1 is also recessed so as to be disposed more externally in the longitudinal direction of the first housing 11 than the end wall base inner surface 15*h*.

Note that the end surface 14*d* of the extension end part 14 and the end wall base inner surface 15*h* serving as the inner surface of the inner end part 15*g* are contained in the exposed side face which is exposed so as not to be covered with the first reinforcing bracket 51 on the side face of the first protruding end part 18. Moreover, the upper surface 14*a* of the extension end part 14 and the upper surface 15*a* of the end wall part 15 form a flush flat surface and are recessed so as to be disposed below (towards the negative Z-axis direction of) the mating surface 12*a* serving as the upper surface of the first projection 12.

In addition, once the left half body part 10A and the right half body part 10B are abutted, that is, the end wall part 15 of the left half body part 10A and the end wall part 15 of the right half body part 10B are abutted such that coupling surfaces 15*d* are mutually abutted, the first reinforcing bracket 51 is installed so as to cover at least part of the extension end parts 14 and the end wall part 15 on both sides thereof and fix them, with the left half body part 10A and the right half body part 10B coupled.

The first reinforcing bracket 51 is a member integrally formed by subjecting a metal plate to processing such as punching and bending, and includes an upper plate extending in the width direction of the first housing 11, a pair of end wall holding plates connected to both side edges of this upper plate so as to hold the end wall part 15, and a pair of extension end holding plates connected to both ends of the upper plate so as to hold the extension end part 14. Specifically, the upper plate includes an end wall upper surface covering part 57 covering the upper surface 15*a* of the end wall part 15, along with an extension end upper surface covering part 54 connected on both left and right ends of this end wall upper surface covering part 57 so as to cover the upper surface 14*a* of the extension end part 14. Moreover, the end wall holding plate includes an end wall outer surface covering part 52 and an end wall inner surface covering part 53 which are respectively connected to the outer and inner edges of the end wall upper surface covering part 57. Furthermore, the extension end holding plate includes a leg part 55 connected to the outer end of the extension end upper surface covering part 54. Note that a tail part 56 is connected to the lower end of each leg part 55.

The end wall upper surface covering part 57 is a strip member extending in the width direction of the first connector 1 as a whole and covers the majority of the upper surface 15*a* of the left and right end wall parts 15 in which the coupling surfaces 15*d* are mutually abutted.

In addition, the end wall outer surface covering part 52 is a plate member extending in the width and vertical directions of the first connector 1 as a whole and is connected to the outer edge of the end wall upper surface covering part 57 via an upper curved part 52*a* formed at the upper end thereof. Moreover, a lower curved part 52*b* is formed in the vicinity of the lower end. As illustrated in FIG. 5C and FIG. 6C, when seen from the width direction (Y-axis direction) of the first connector 1, the end wall outer surface covering part 52 is substantially S shaped, such that the upper curved part 52*a* and the lower curved part 52*b* are curved in mutually opposite directions. Moreover, the end wall outer surface covering part 52 is formed so as to advance internally in the longitudinal direction of the first connector 1 as it descends as a whole, wherein the lower curved part 52*b* is disposed more internally in the longitudinal direction of the first connector 1 than the upper curved part 52*a*. Note that the lower end of the end wall outer surface covering part 52 is tilted so as to face the outside in the longitudinal direction of the first connector 1, that is, so as to be separated from the outer surface 15*b* of the end wall part 15. Moreover, the lower end of the end wall outer surface covering part 52 is disposed above (towards the positive Z-axis direction of) the lower surface of the tail part 56 so as not to abut the surface of the first substrate. Note that, as required, the lower end of the end wall outer surface covering part 52 can approach or abut the surface of the first substrate. In this case, when the lower end of the end wall outer surface covering part 52 is connected to the connection pad of the first substrate by soldering, etc., the connection strength of the first reinforcing bracket 51 to the first substrate is improved.

Moreover, the end wall inner surface covering part 53 is a plate member extending in the width and vertical directions of the first connector 1 as a whole and is connected to the inner edge of the end wall upper surface covering part 57 via an upper curved part 53*a* formed at the upper end thereof. Moreover, a lower curved part 53*b* is formed in the vicinity of the lower end. As illustrated in FIG. 6C, when seen from the width direction (Y-axis direction) of the first connector 1, the end wall inner surface covering part 53 is substantially S shaped, such that the upper curved part 53*a* and the lower curved part 53*b* are curved in mutually opposite directions. Moreover, the end wall inner surface covering part 53 is formed so as to advance externally in the longitudinal direction of the first connector 1 as it descends as a whole, wherein the lower curved part 53*b* is disposed more externally in the longitudinal direction of the first connector 1 than the upper curved part 52*a*. Note that the lower end of the end wall inner surface covering part 53 is tilted so as to face the inside in the longitudinal direction of the first connector 1, that is, so as to be separated from the inner surface 15*c* of the end wall part 15. Moreover, the lower end of the end wall inner surface covering part 53 is disposed above the lower surface of the tail part 56 so as not to abut the surface of the first substrate. Note that, as required, the lower end of the end wall inner surface covering part 53 can approach or abut the surface of the first substrate. In this case, when the lower end of the end wall inner surface covering part 53 is connected to the connection pad of the first substrate by soldering, etc., the connection strength of the first reinforcing bracket 51 to the first substrate is improved.

As illustrated in FIG. 6C, in the first reinforcing bracket 51 prior to the installation thereof to the first protruding end part 18, the interval between the end wall outer surface covering part 52 and the end wall inner surface covering part 53 is narrowest at the lower curved part 52*b* of the end wall outer surface covering part 52 and the lower curved part 53*b* of the end wall inner surface covering part 53. Specifically, if the interval between the inner surface of the upper curved part 52*a* of the end wall outer surface covering part 52 and the inner surface of the upper curved part 53*a* of the end wall inner surface covering part 53 is defined as L3, while the interval between the inner surface of the lower curved part 52*b* of the end wall outer surface covering part 52 and the inner surface of the lower curved part 53*b* of the end wall inner surface covering part 53 is defined as L4, L3≥L4 (preferably, L3>L4). Moreover, the thicknesses (dimensions in the X-axis direction) of the thick part 15*e* and the thin part 15*f* of the end wall part 15 are respectively defined as l3 and l4, L3≥l3 (preferably, L3>l3). In addition, L4<l3 prior to the installation of the first reinforcing bracket 51 to the first protruding end part 18, while L4>l4 after the installation thereof.

When the first reinforcing bracket 51 is installed at the first protruding end part 18 in this relationship, the first reinforcing bracket 51 assuredly holds the thick part 15*e* of the end wall part 15 in which the inner surface 52*c* of the end wall outer surface covering part 52 and the inner surface 53*c* of the end wall inner surface covering part 53 are abutted. Specifically, when L3>l3, the inner surface 52*c* of the end wall outer surface covering part 52 and the inner surface 53*c* of the end wall inner surface covering part 53 hold and press an outer projection surface lower edge 15*b*3 and an inner projection surface lower edge 15*c*3 which serve as the lower edges of the thick part 15*e*. As a result, the first reinforcing bracket 51 is prevented from being removed from the first protruding end part 18.

Furthermore, the extension end upper surface covering part 54 covers the majority of the upper surfaces 14*a* of left and right extension end parts 14.

In addition, the leg part 55 is a strip member extending in the vertical direction of the first connector 1 and is connected to the outer end of the extension end upper surface covering part 54 via an upper curved part 55*a* formed at the upper end thereof. Moreover, a lower curved part 55*b* is formed at the lower end. As illustrated in FIGS. 5A and 5B, etc., when seen from the longitudinal direction (X-axis direction) of the first connector 1, the leg part 55 is substantially S shaped, such that the upper curved part 55*a* and the lower curved part 55*b* are curved in mutually opposite directions. Moreover, the leg part 55 is tilted so as to advance internally in the width direction of the first connector 1 as it descends as a whole, wherein the lower curved part 55*b* is disposed most internally in the width direction of the first connector 1.

As illustrated in FIG. 6B, in the first reinforcing bracket 51 prior to the installation thereof to the first protruding end part 18, the interval between left and right leg parts 55 is narrowest at the lower curved part 55*b*. Specifically, if the interval between the inner surfaces of the left and right upper curved parts 55*a* is defined as L1, while the interval between the inner surfaces of the left and right lower curved parts 55*b* is defined as L2, L1≥L2 (preferably, L1>L2). Moreover, if the interval between the outer projection surfaces 14*b*1 of the left and right extension end parts 14 in the first protruding end part 18 and the interval between outer recessed surfaces 14*b*2 thereof are respectively defined as l1 and l2, L1≥l1 (preferably, L1>l1). In addition, L2<l1 prior to the installation of the first reinforcing bracket 51 to the first protruding end part 18, while L2>l2 after the installation thereof.

When the first reinforcing bracket 51 is installed in the first protruding end part 18 in this relationship, the inner surfaces 55*c* of the left and right leg parts 55 assuredly hold the pressure thick part 14*e* of the extension end part 14. Specifically, when L1>l1, the inner surface 55*c* of the leg part 55 holds and presses an outer projection surface lower edge 14*b*3 serving as the lower edge of the thick part 14*e*. As a result, the first reinforcing bracket 51 is prevented from being removed from the first protruding end part 18.

The tail part 56 is connected to the tip of the lower curved part 55*b* of the leg part 55 and extends externally in the width direction of the first connector 1. Specifically, the tail part 56 extends externally in the width direction from the outer surface 14*b* of the extension end part 14 and is connected and fixed to the connection pad (not illustrated) exposed on the surface of the first substrate by soldering, etc. Furthermore, for example, the connection pad can be coupled with the conductive trace, which is an electric power line.

The method for configuring the first connector 1 by coupling the left half body part 10A and the right half body part 10B via the first reinforcing bracket 51 will hereinafter be described.

Figure 7A:
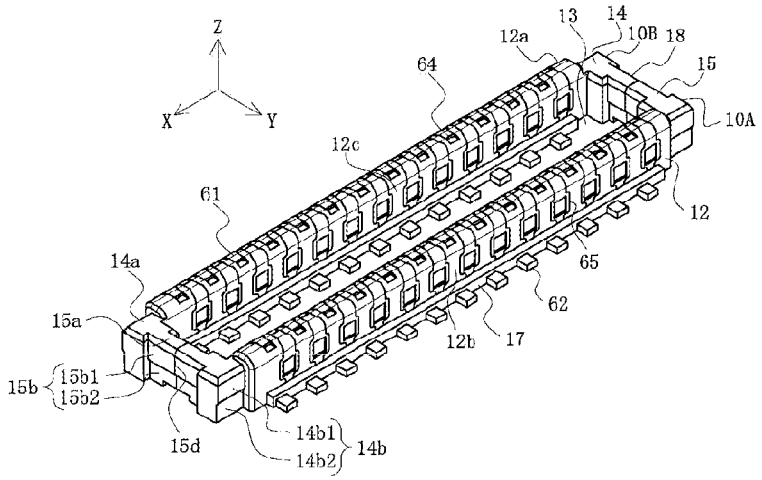
Figure 7B:
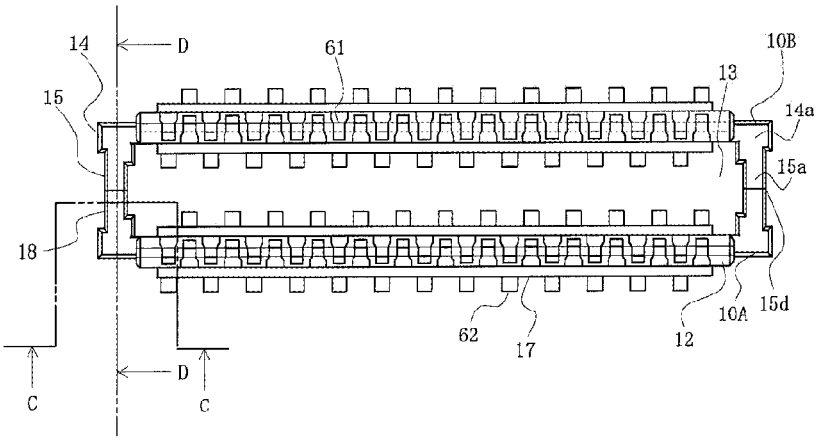
Figure 8A:
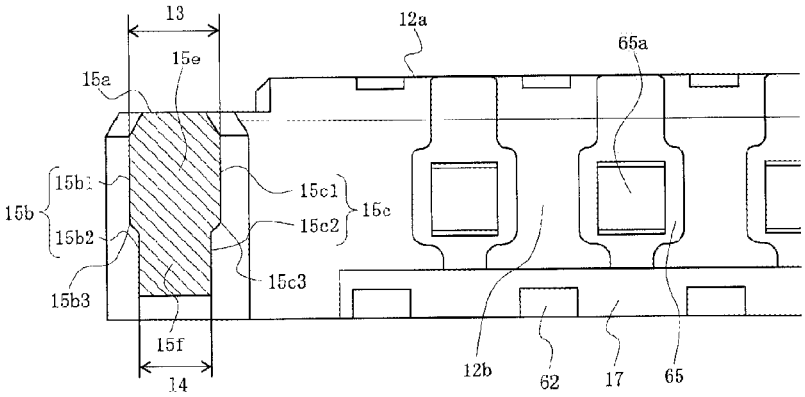
Figure 8B:
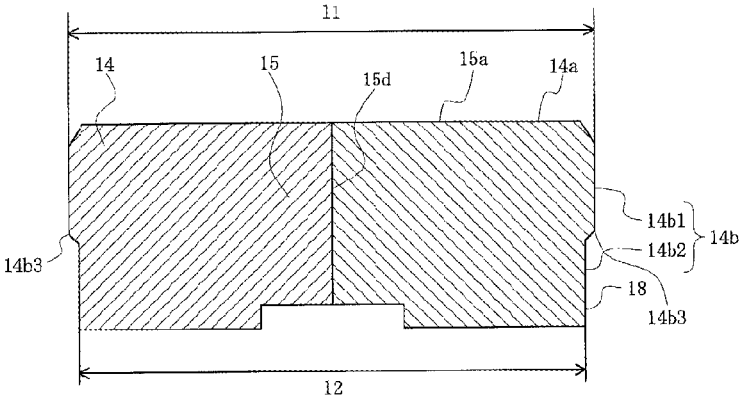
Figure 9:
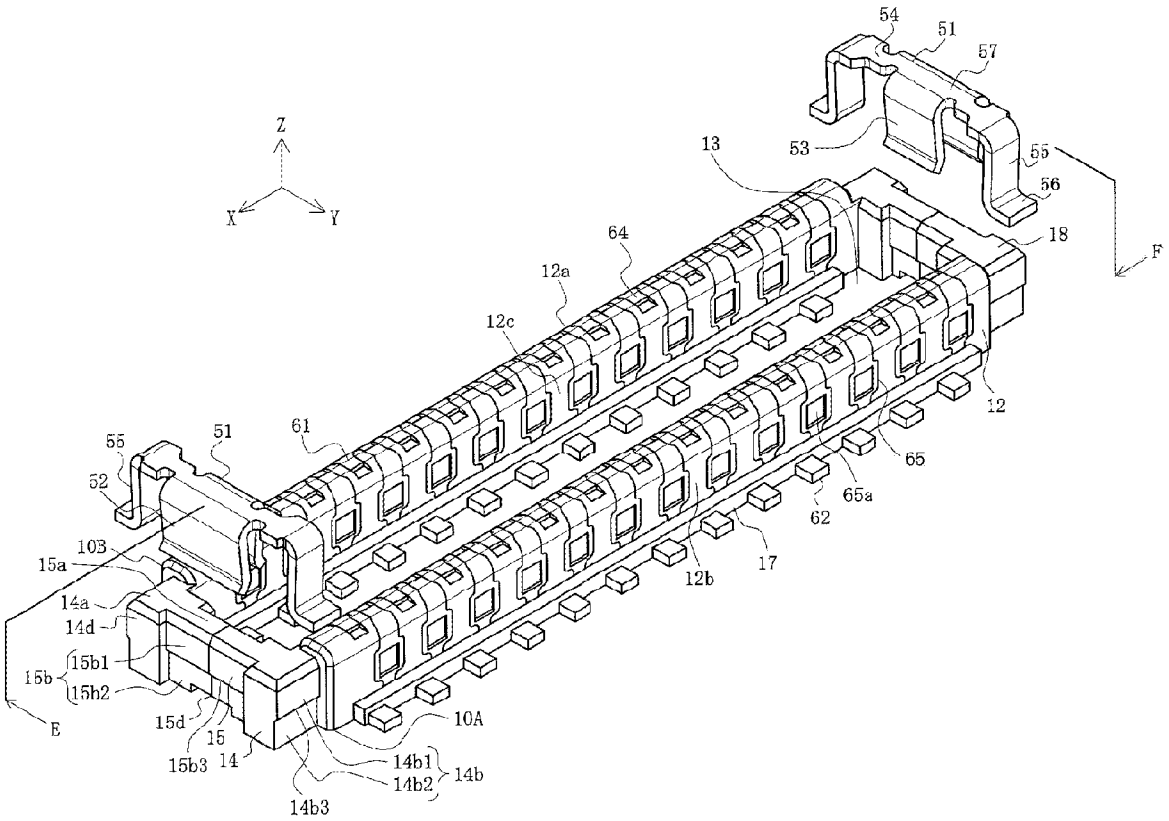
FIG. 9 is a perspective view illustrating the state immediately before coupling the pair of mutually abutted half parts according to Embodiment 1 with a first reinforcing bracket.
Figure 10A:
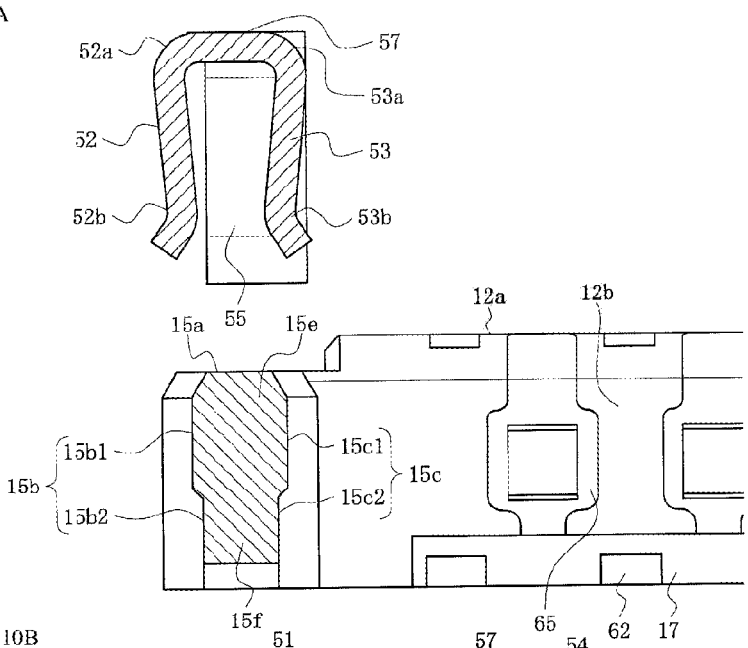
Figure 10B:
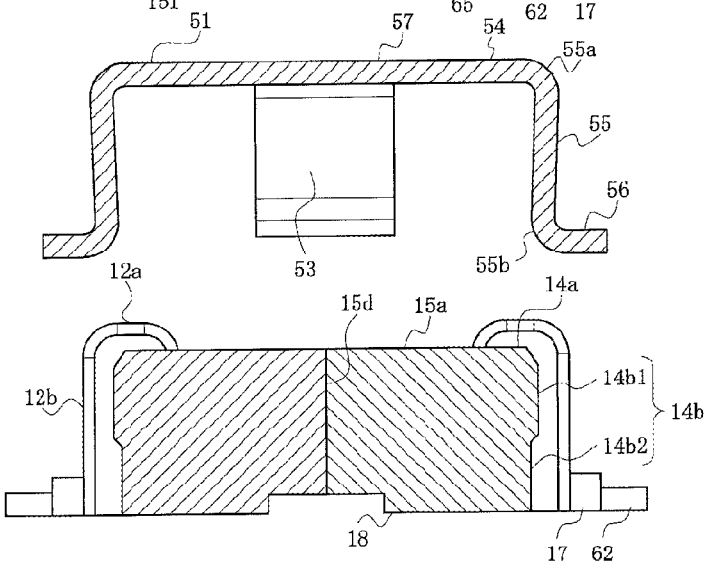

FIGS. 7A-7B are two-face views of a pair of mutually abutted half parts according to Embodiment 1, FIGS. 8A-8B are cross sectional views of the main parts of a pair of mutually abutted half parts according to Embodiment 1, FIG. 9 is a perspective view illustrating the state immediately before coupling the pair of mutually abutted half parts according to Embodiment 1 with a first reinforcing bracket, and FIGS. 10A-10B are cross sectional views of the main parts illustrating the state immediately before coupling the pair of mutually abutted half parts according to Embodiment 1 with the first reinforcing bracket. Note that in FIGS.

7A-7B, FIG. 7A is a perspective view, while FIG. 7B is a top view, in FIGS. 8A-8B, FIG. 8A is a cross sectional view in the arrow direction along line C-C in FIG. 7B, while FIG. 8B is a cross sectional view in the arrow direction along line D-D in FIG. 7B, and in FIGS. 10A-10B, FIG. 10A is a cross sectional view in the arrow direction along line E-E in FIG. 9, while FIG. 10B is a cross sectional view in the arrow direction along line F-F in FIG. 9.

When configuring the first connector 1, as illustrated in FIGS. 7A-7B, an operator first abuts the left half body part 10A and the right half body part 10B. That is, the end wall part 15 of the left half body part 10A and the end wall part 15 of the right half body part 10B are abutted, while the coupling surface 15*d* at the tip of the end wall part 15 of the left half body part 10A and the coupling surface 15*d* at the tip of the end wall part 15 of the right half body part 10A are abutted. As a result, the first protruding end part 18 is configured.

Subsequently, as illustrated in FIG. 9, the operator disposes the first reinforcing bracket 51 above the configured first protruding end part 18, relatively lowers this first reinforcing bracket 51 to the first protruding end part 18, and installs the first reinforcing bracket 51 so as to cover at least a portion of the extension end parts 14 and the end wall part 15 on both sides. In this case, the posture of the first reinforcing bracket 51 is controlled such that the end wall upper surface covering part 57 faces the upper surfaces 15*a* of left and right the end wall parts 15 with the coupling surfaces 15*d* mutually abutted, the extension end upper surface covering part 54 faces the upper surfaces 14*a* of left and right extension end parts 14, the end wall outer surface covering part 52 faces the outer surface 15*b* of the end wall part 15, the end wall inner surface covering part 53 faces the inner surface 15*c* of the end wall part 15, and the leg part 55 faces the outer surfaces 14*b* of the extension end parts 14.

As mentioned above, in the first reinforcing bracket 51 prior to the installation thereof to the first protruding end part 18, the interval between the end wall outer surface covering part 52 and the end wall inner surface covering part 53 is narrowest at the lower curved part 52*b* of the end wall outer surface covering part 52 and the lower curved part 53*b* of the end wall inner surface covering part 53. Specifically, if the interval between the inner surface of the upper curved part 52*a* of the end wall outer surface covering part 52 and the inner surface of the upper curved part 53*a* of the end wall inner surface covering part 53 is defined as L3, while the interval between the inner surface of the lower curved part 52*b* of the end wall outer surface covering part 52 and the inner surface of the lower curved part 53*b* of the end wall inner surface covering part 53 is defined as L4, L3≥L4 (preferably, L3>L4). Moreover, the thicknesses (dimensions in the X-axis direction) of the thick part 15*e* and the thin part 15*f* of the end wall part 15 are respectively defined as l3 and l4, L3≥l3 (preferably, L3>l3). In addition, L4<l3 prior to the installation of the first reinforcing bracket 51 to the first protruding end part 18, while L4>l4 after the installation thereof.

Furthermore, the interval between the left and right leg parts 55 is narrowest at the lower curved part 55*b*. Specifically, if the interval between the inner surfaces of the left and right upper curved parts 55*a* is defined as L1, while the interval between the inner surfaces of the left and right lower curved parts 55*b* is defined as L2, L1≥L2 (preferably, L1>L2). Moreover, if the interval between the outer projection surfaces 14*b*1 of the left and right extension end parts 14 in the first protruding end part 18 and the interval between outer recessed surfaces 14*b*2 thereof are respectively defined as l1 and l2, L1≥l1 (preferably, L1>l1). In addition, L2<l1 prior to the installation of the first reinforcing bracket 51 to the first protruding end part 18, while L2>l2 after the installation thereof.

Therefore, when the first reinforcing bracket 51 is installed so as to be relatively lowered to the first protruding end part 18, the interval between the end wall outer surface covering part 52 and the end wall inner surface covering part 53 is expanded by the end wall part 15, with the end wall outer surface covering part 52 and the end wall inner surface covering part 53 elastically deforming. Moreover, the interval between the left and right leg parts 55 is expanded by the extension end part 14, such that the left and right leg parts 55 elastically deform.

In addition, as illustrated in FIG. 1 and FIGS. 2A-2C, upon completion of the installation of the first reinforcing bracket 51 at the first protruding end part 18, when the left half body part 10A and the right half body part 10B are coupled via the first reinforcing bracket 51, spring characteristics exerted by the end wall outer surface covering part 52 and the end wall inner surface covering part 53 fasten the end wall part 15 from the front and rear, while spring characteristics exerted by the left and right leg parts 55 fasten the extension end part 14 from the left and right. Therefore, the end wall part 15 is fastened by the first reinforcing bracket 51 from the front, rear, left, and right, such that the mutually abutted coupling surfaces 15*d* are closely contacted and integrated. As a result, the left half body part 10A and the right half body part 10B are coupled via the first reinforcing bracket 51 so as to configure the first connector 1.

Moreover, because the lower curved part 52*b* of the end wall outer surface covering part 52 and the lower curved part 53*b* of the end wall inner surface covering part 53 (which have a narrower mutual interval than the interval between the outer projection surface 15*b*1 and the inner projection surface 15*c*1) are disposed below the outer projection surface 15*b*1 and the inner projection surface 15*c*1, when the first reinforcing bracket 51 is raised relative to the end wall part 15 and removed, the lower curved part 52*b* of the end wall outer surface covering part 52 and the lower curved part 53*b* of the end wall inner surface covering part 53 are hooked at the step between the outer projection surface 15*b*1 and the outer recessed surface 15*b*2 and the step between the inner projection surface 15*c*1 and the inner recessed surface 15*c*2, causing difficulty removing them. That is, the function of preventing the first reinforcing bracket 51 from coming off is exerted.

Likewise, because the lower curved parts 55*b* of the left and right leg parts 55 (which have a narrower mutual interval than the interval between left and right outer projection surfaces 14*b*1) are disposed below the outer projection surfaces 14*b*1, when the first reinforcing bracket 51 is raised relative to the end wall part 15 and removed, the lower curved part 55*b* of the leg part 55 is hooked at the step between the outer projection surface 14*b*1 and the outer recessed surface 14*b*2, causing difficulty removing it. That is, the function of preventing the first reinforcing bracket 51 from coming off is exerted.

Moreover, if the interval between the vicinity part of the upper curved part 52*a* in the end wall outer surface covering part 52 and the vicinity part of the upper curved part 53*a* in the end wall inner surface covering part 53 is narrower than the interval between the outer projection surface 15*b*1 and the inner projection surface 15*c*1, the thick part 15*e* of the end wall part 15 is held from both sides thereof by the end wall outer surface covering part 52 and the end wall inner surface covering part 53, with the end wall part 15 of the left half body part 10A and the end wall part 15 of the right half body part 10B thereby firmly coupled.

Likewise, if the interval between the vicinity parts of the upper curved parts 55*a* in the left and right leg parts 55 is narrower than the interval between the outer projection surfaces 14*b*1 of the left and right extension end parts 14, the thick part 14*e* of the extension end parts 14 is held from both sides thereof by the leg part 55, with the end wall part 15 of the left half body part 10A and the end wall part 15 of the right half body part 10B thereby firmly coupled.

Furthermore, if the interval between the lower curved part 52*b* of the end wall outer surface covering part 52 and the lower curved part 53*b* of the end wall inner surface covering part 53 is narrower than the interval between the outer recessed surface 15*b*2 and the inner recessed surface 15*c*2, the thin part 15*f* of the end wall part 15 is held from both sides thereof by the lower curved part 52*b* of the end wall outer surface covering part 52 and the lower curved part 53*b* of the end wall inner surface covering part 53, with the end wall part 15 of the left half body part 10A and the end wall part 15 of the right half body part 10B thereby more firmly coupled.

Likewise, if the interval between the lower curved parts 55*b* of the left and right leg parts 55 is narrower than the interval between the outer recessed surfaces 14*b*2 of the left and right extension end parts 14, the thin part 14*f* of the extension end parts 14 is held from both sides thereof by the lower curved part 55*b* of the leg part 55, with the end wall part 15 of the left half body part 10A and the end wall part 15 of the right half body part 10B thereby firmly coupled.

Moreover, upon completion of the installation of the first reinforcing bracket 51 to the first protruding end part 18, the upper surface 14*a* of the extension end part 14 and the upper surface 15*a* of the end wall part 15 are recessed so as to be disposed below the mating surface 12*a* serving as the upper surface of the first projection 12, with the upper surfaces of the end wall upper surface covering part 57 and the extension end upper surface covering part 54 thereby recessed so as to be flush with the mating surface 12*a* or disposed below this mating surface 12*a*. That is, the upper surfaces of the end wall upper surface covering part 57 and the extension end upper surface covering part 54 do not protrude from the mating surface 12*a*.

Furthermore, because the entire outer surface 14*b* of the extension end part 14 is recessed so as to be disposed more internally in the width direction of the first connector 1 than the outer surface 12*b* of the first projection 12, the outer surface of the leg part 55 is recessed so as to be flush with the outer surface 12*b* or disposed more internally in the width direction of the first connector 1 than this outer surface 12*b*. That is, the outer surface of the leg part 55 does not protrude from the outer surface 12*b*.

Furthermore, because the entire outer surface 15*b* of the end wall part 15 is recessed so as to be disposed more internally in the longitudinal direction of the first connector 1 than the end surface 14*d* of the extension end part 14, the outer surface of the end wall outer surface covering part 52 is recessed so as to be flush with the end surface 14*d* or disposed more internally in the longitudinal direction of the first connector 1 than this end surface 14*d*. That is, the outer surface of the end wall outer surface covering part 52 does not protrude from the end surface 14*d*.

Furthermore, because the entire inner surface 15*c* of the end wall part 15 is recessed so as to be disposed more externally in the longitudinal direction of the first connector 1 than the end wall base inner surface 15*h*, the outer surface of the end wall inner surface covering part 53 is recessed so as to be flush with the end wall base inner surface 15*h* or disposed more externally in the longitudinal direction of the first connector 1 than this end wall base inner surface 15*h*. That is, the outer surface of the end wall inner surface covering part 53 does not protrude from the end wall base inner surface 15*h*.

Note that the tail part 56 connected to the tip of the lower curved part 55*b* of the leg part 55 protrudes more externally in the width direction of the first connector 1 than the outer surface 12*b* of the first projection 12. Moreover, the lower surface of the tail part 56 is nearly flush with the lower surface of the tail part 62 of the first terminal 61 installed on the first projection 12, along with the mounting surface 17*a* of the first housing 11.

Moreover, the lower end of the end wall outer surface covering part 52 and the lower end of the end wall inner surface covering part 53 are disposed above the lower surface of the tail part 56, and therefore disposed above the mounting surface 17*a* of the first housing 11. Therefore, the lower end of the end wall outer surface covering part 52 and the lower end of the end wall inner surface covering part 53 do not contact the surface of the first substrate.

Next, the configuration of the second connector 101 will be described.

Figure 11:
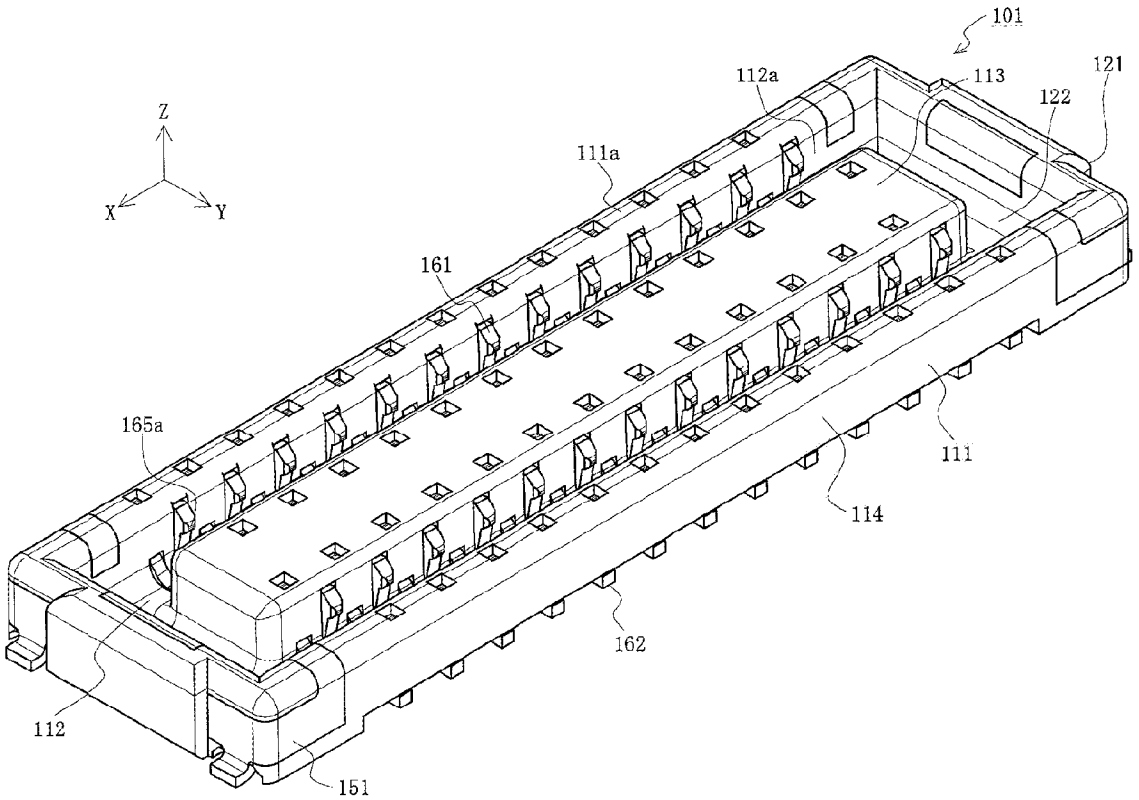
FIG. 11 is a perspective view of a second connector according to Embodiment 1.
Figure 12:
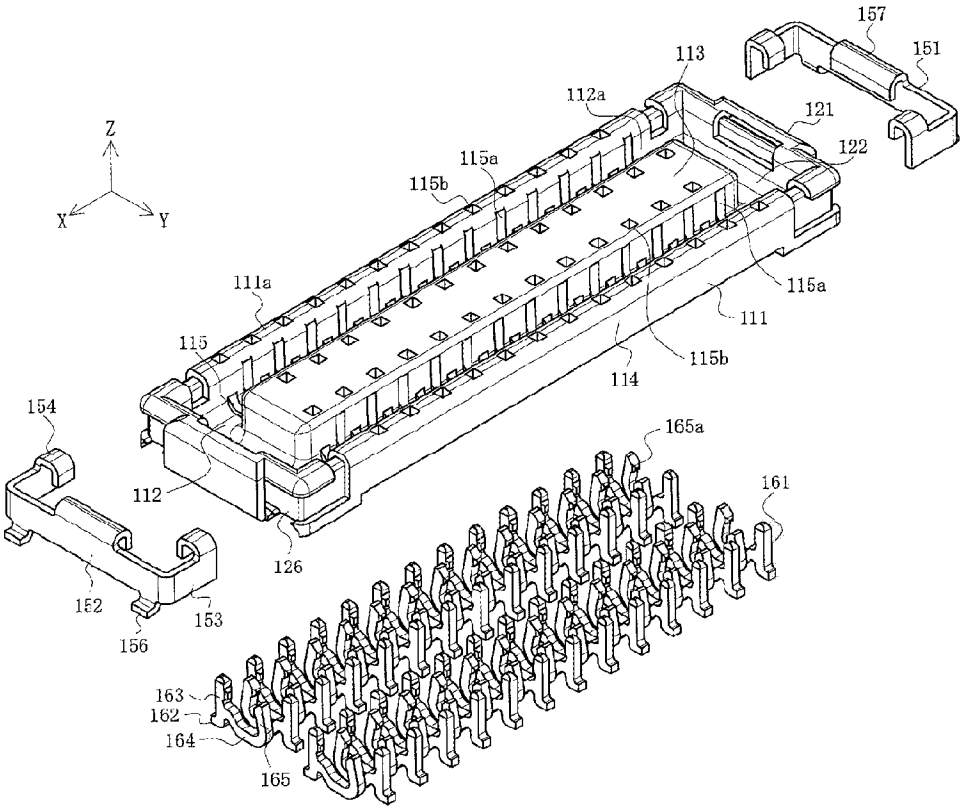
FIG. 12 is an exploded view of the second connector according to Embodiment 1.

FIG. 11 is a perspective view of a second connector according to Embodiment 1, while FIG. 12 is an exploded view of the second connector according to Embodiment 1.

The second connector 101 as a counterpart connector according to the present embodiment has a second housing 111 as a counterpart connector body integrally formed of an insulating material such as synthetic resin. As illustrated in the figure, this second housing 111 is a substantially rectangular body with the shape of a substantially rectangular thick plate. In addition, there is a substantially rectangular recess 112 with the surroundings thereof enclosed on the side at which the first connector 1 of the second housing 111 is inserted, in other words, the mating surface 111*a* side (positive z-axis direction), and the recess 112 is formed to mate with the first housing 11. In addition, a second projection 113 as an insular part that mates with the recessed groove part 13 in the recess 112 is integrally formed with a second housing 111 and side wall parts 114 extending parallel with this second projection 113 are integrally formed with the second housing 111 on both sides of the second projection 113.

The second projection 113 and the side wall part 114 protrude upwards from the underside of the recess 112 (positive z-axis direction) and extend in the longitudinal direction of the second connector 101. Therefore, a recessed groove part 112*a* that is an elongated recess extending in the longitudinal direction (x-axis direction) of the second connector 101 is formed as part of the recess 112 on both sides of the second projection 113.

A second terminal housing groove cavity 115*a* in the shape of a recessed groove is formed on the side surfaces of both sides of the second projection 113 and the side surface of the interior of the side wall part 114. In addition, a second terminal housing hole cavity 115*b* in a hole shape is formed on the second projection 113 and the side wall part 114. In addition, as the second terminal housing groove cavity 115*a* and the second terminal housing hole cavity 115*b* are mutually integrated with each other on the underside of the recessed groove part 112*a*, if the second terminal housing groove cavity 115*a* and the second terminal housing hole cavity 115*b* are comprehensively described, they are described as the second terminal housing cavity 115. The second terminal housing cavities 115 are arranged at a pitch corresponding to the first terminal 61 and at the appropriate corresponding number.

The second terminal 161 is a member integrally formed by applying a process such as punching or the like to a conductive metal plate, and includes a main body part 163, a tail part 162 connected to the bottom end part of the main body part 163, a connecting part 164 that extends in the width direction (y-axis direction) of the second connector 101 from the vicinity of the bottom end of the main body part 163, and a contact part 165 that extends upwards (positive z-axis direction) from this connecting part 164. Furthermore, a contact projection 165*a* that extends towards the main body part 163 is preferably formed in the vicinity of the tip of the contact part 165.

The main body part 163 is a part that is press fit and retained in the second terminal housing hole cavity 115*b*. In addition, the tail part 162 is bent and connected to the lower end of the main body part 163, extended in the width direction of the second housing 111, and connected to the connection pad coupled with the conductive trace of the second substrate by soldering or the like. Note that the conductive trace is typically a signal line. Furthermore, the contact part 165 is a part that contacts the first terminal 61 equipped on the first connector 1 when the first connector 1 and the second connector 101 are mated, with the contact projection 165 a preferably engaged with the contact recess 65*a* formed on the contact part 65 of the first terminal 61.

The second terminal 161 is inserted into the second terminal housing cavity 115 from the lower part of the second housing 111 and installed in the second housing 111. Thus, the main body part 163 of the second terminal 161 is press fit and retained in the second terminal housing hole cavity 115*b*, the contact part 165 is exposed to the recessed groove part 112*a* housed in the second terminal housing groove cavity 115*a*, and the lower surface of the tail part 162 is exposed to the lower surface of the second housing 111 that is the mounting surface 111*b*.

In addition, similar to the first terminal 61, the second terminal 161 installed in each of the recessed groove parts 112*a* is oriented such that the posture of those that are adjacent will face opposing directions in regards to the width direction of the recessed groove part 112*a*. Regarding the examples illustrated in FIG. 12, the arrangement of the second terminal 161 positioned on the front end (positive x-axis direction end) of the second terminal 161 installed in the recessed groove part 112*a* on the side in the positive y-axis direction is oriented such that the tail part 162 protrudes in the negative y-axis direction, while in contrast, the arrangement of the second terminal 161 positioned second from the front end is oriented such that the tail part 62 protrudes in the positive y-axis direction. In this manner, as the second terminals 161 are installed in the recessed groove part 112*a* arranged in a line in alternating directions, the pitch of the tail parts 162 exposed on the mounting surface 111*b* on both sides of the recessed groove part 112*a* is set to double the pitch of the second terminals 161. Therefore, connection work by soldering or the like to the connection pad of the second substrate can easily be performed. In addition, the pitch of the contact part 165 exposed to the recessed groove part 112*a* is set to double the pitch of the second terminals 161.

Moreover, each second protruding end part 121 as a mating guide part is arranged on both ends in the longitudinal direction of the second housing 111. A mating recess 122 as a portion of the recess 112 is formed on each second protruding end part 121. The mating recess 122 is a substantially rectangular recess connected to both ends in the longitudinal direction of each recessed groove part 112*a*. Moreover, in the state in which the first connector 1 and the second connector 101 are mated, a first protruding end part 18 contained in first connector 1 is inserted into the mating recess 122. In addition, the second protrusion end part 121 includes a reinforcing bracket housing recess 126. Moreover, as the counterpart reinforcing bracket, a second reinforcing bracket 151 is housed in the reinforcing bracket housing recess 126 and installed at the second protrusion end part 121.

The second reinforcing bracket 151 is a member that is integrally formed by applying processes such as punching and bending and the like to a metal plate, and is equipped with a second main body part 152 that extends in the width direction of the second housing 111, a center covering part 157 that is connected to the upper end of the second main body part 152, a lateral covering part 153 that is connected to both the left and right ends of the second main body part 152, a contact side plate part 154 that is connected to one edge of the lateral covering part 153, and a tail part 156 that is connected to the bottom end of the second main body part 152. The tail part 156 extends externally in the longitudinal direction of the second connector 101 and is connected and fixed to the connection pad (not illustrated) exposed on the surface of the second substrate through soldering or the like. Furthermore, for example, the connection pad is preferably coupled with a conductive trace, which is an electric power line.

The operation for mating the first connector 1 and the second connector 101 having the abovementioned configuration will be described next.

Here, the first connector 1 is mounted on the surface of the first substrate by connecting the tail part 62 of the first terminal 61 to a connection pad coupled to a conductive trace of the first substrate (not illustrated) by soldering, etc., and connecting a tail part 56 of a first reinforcing bracket 51 to a connection pad coupled to the conductive trace of the first substrate by soldering, etc. Note that the conductive trace coupled to the connection pad with the tail part 62 of the first terminal 61 connected thereto is a signal line, while the conductive trace coupled to the connection pad with the tail part 56 of the first reinforcing bracket 51 connected thereto is an electric power line.

Likewise, the second connector 101 is mounted on the surface of the second substrate by connecting the tail part 162 of the second terminal 161 to a connection pad coupled to a conductive trace of the second substrate (not illustrated) by soldering, etc., and connecting the tail part 156 of the second reinforcing bracket 151 to a connection pad coupled to the conductive trace of the second substrate by soldering, etc. Note that the conductive trace coupled to the connection pad with the tail part 162 of the second terminal 161 connected thereto is a signal line, while the conductive trace coupled to the connection pad with the tail part 156 of the second reinforcing bracket 151 connected thereto is an electric power line.

First, when an operator makes a mating surface 12*a* of the first projection 12 as the mating surface of the first housing 11 of the first connector 1 face the mating surface 111*a* of the second housing 111 of the second connector 101, the position of the first projection 12 of the first connector 1 coincides with the position of the corresponding recessed groove 112*a* of the second connector 101, while the position of the first protruding end part 18 of the first connector 1 coincides with the position of the corresponding mating recess 122 of the second connector 101, thereby completing the alignment between the first connector 1 and the second connector 101.

In this state, if the first connector 1 and/or the second connector 101 are moved in the direction approaching the counterpart side, that is, the mating direction, the first projection 12 and the first protruding end part 18 of the first connector 1 are inserted into the recessed groove 112*a* and the mating recess 122 of the second connector 101. Consequently, the mating between the first connector 1 and the second connector 101 is completed. In addition, the first terminal 61 and the second terminal 161 enter a conducting state.

In this manner, in the present embodiment, the first connector 1 includes: a left and right pair made up of the left half body part 10A and the right half body part 10B, each of which includes the first housing 11 along with multiple first terminals 61 installed in the first housing 11; and the first reinforcing bracket 51 which is installed in the first protruding end part 18 formed on both ends of the first housings 11 by abutting the first housings 11 of the left half body part 10A and the right half body part 10B, and couples the left half body part 10A and the right half body part 10B, wherein each of the first housings 11 includes: the first projection 12 extending in the longitudinal direction thereof so as to retain the first terminals 61; the extension end part 14 connected to both ends in the longitudinal direction of the first projection 12; and the end wall part 15 extending from the extension end part 14 towards the counterpart half body part, wherein each of the first protruding end part 18 includes: mutually abutted left and right end wall parts 15; and the left and right extension end parts 14 with the end wall part 15 extending therefrom.

This enables narrowing of the interval between the first housings 11 in which multiple first terminals 61 are installed enabling a reduction in the size of the first connector 1. In addition, manufacturing the first connector 1 is simplified and the reliability of the first connector 1 is improved.

Moreover, the first reinforcing bracket 51 includes: the end wall upper surface covering part 57 and the extension end upper surface covering part 54 which serve as upper plates extending in the width direction of the first housing 11; the end wall outer surface covering part 52 and the end wall inner surface covering part 53 which are connected to both side edges of the upper plate to serve as a pair of end wall holding plates for holding the end wall part 15; and the leg part 55 which is connected at both ends of the upper plate to serve as a pair of extension end holding plates for holding the extension end part 14, wherein the end wall upper surface covering part 57 faces the upper surface 15*a* of the end wall part 15, the extension end upper surface covering part 54 is connected to both ends of the end wall upper surface covering part 57 to face the upper surface 14*a* of the extension end part 14, the end wall outer surface covering part 52 faces the outer surface 15*b* of the end wall part 15, the end wall inner surface covering part 53 faces the inner surface 15*c* of the end wall part 15, and the leg part 55 is connected to the outer end of the extension end upper surface covering part 54 to face the outer surface 14*b* of the extension end part 14. As a result, the end wall part 15 of the left half body part 10A and the end wall part 15 of the right half body part 10B are firmly coupled to assuredly configure the first protruding end part 18, with the left half body part 10A and the right half body part 10B assuredly coupled.

Furthermore, the upper surface 15*a* of the end wall part 15 and the upper surface 14*a* of the extension end part 14 are recessed from the mating surface 12*a* of the first projection 12, the outer surface 15*b* of the end wall part 15 is recessed from the end surface 14*d* of the extension end part 14, the inner surface 15*c* of the end wall part 15 is recessed from the end wall base inner surface 15*h*, the outer surface 14*b* of the extension end part 14 is recessed from the outer surface 12*b* of the first projection 12, the end wall upper surface covering part 57 and the extension end upper surface covering part 54 do not protrude from the mating surface 12*a* of the first projection 12, the end wall outer surface covering part 52 and the end wall inner surface covering part 53 do not protrude from the end surface 14*d* or the end wall base inner surface 15*h* which serve as the exposed side faces of the first protruding end part 18, and the leg part 55 does not protrude from the outer surface 12*b* of the first projection 12. Therefore, the surface of the first reinforcing bracket 51 does not protrude from the surface of the first housing 11.

Furthermore, the end wall part 15 includes the thick part 15*e* along with the thin part 15*f* connected to the lower side of the thick part 15*e*, while the extension end part 14 includes the thick part 14*e* along with the thin part 14*f* connected to the lower side of the thick part 14*e*, wherein, in the first reinforcing bracket 51 prior to the installation thereof to the first protruding end part 18, the interval between the lower curved part 52*b* of the end wall outer surface covering part 52 and the lower curved part 53*b* of the end wall inner surface covering part 53 as the nearest parts of the end wall holding plates is narrower than the interval between the outer surface 15*b* and the inner surface 15*c* at the location corresponding to the thick part 15*e* of the end wall part 15, while the interval between the lower curved parts 55*b* of the left and right leg parts 55 as the nearest parts of the extension end holding plates is narrower than the interval between the outer surfaces 14*b* at the location corresponding to the thick part 14*e* of the extension end part 14. As a result, when the first reinforcing bracket 51 is installed in the first protruding end part 18, the end wall outer surface covering part 52 and the end wall inner surface covering part 53 are expanded, while the left and right leg parts 55 are expanded. Therefore, upon completion of the installation of the first reinforcing bracket 51 at the first protruding end part 18, the end wall outer surface covering part 52 and the end wall inner surface covering part 53 exert spring characteristics to fasten the end wall part 15 from the front and rear, while the left and right leg parts 55 exert spring characteristics to fasten the extension end part 14 from the left and right. Therefore, the end wall part 15 is fastened by the first reinforcing bracket 51 from the front, rear, left, and right, such that the mutually abutted coupling surfaces 15*d* are closely contacted and integrated, thereby assuredly configuring the first protruding end part 18.

Furthermore, the outer surface 15*b* of the end wall part 15 includes a step between the outer projection surface 15*b*1 corresponding to the thick part 15*e* and the outer recessed surface 15*b*2 corresponding to the thin part 15*f*, the inner surface 15*c* of the end wall part 15 includes a step between the inner projection surface 15*c*1 corresponding to the thick part 15*e* and the inner recessed surface 15*c*2 corresponding to the thin part 15*f*, and the outer surface 14*b* of the extension end part 14 includes a step between the outer projection surface 14*b*1 corresponding to the thick part 14*e* and the outer recessed surface 14*b*2 corresponding to the thin part 14*f*. As a result, even if an upward external force is applied to the first reinforcing bracket 51 installed at the first protruding end part 18, the lower curved part 52*b* of the end wall outer surface covering part 52, the lower curved part 53*b* of the end wall inner surface covering part 53, and the lower curved part 55*b* of the leg part 55 are hooked at steps, causing difficulty removing the first reinforcing bracket 51. Therefore, the first reinforcing bracket 51 is assuredly prevented from coming off.

Next, Embodiment 2 will be described. Note that the description of elements having the same structures as those of Embodiment 1 will be omitted by being denoted using the same reference numerals. Furthermore, a description of operations and effects that are the same as those of Embodiment 1 will be omitted.

Figure 13:
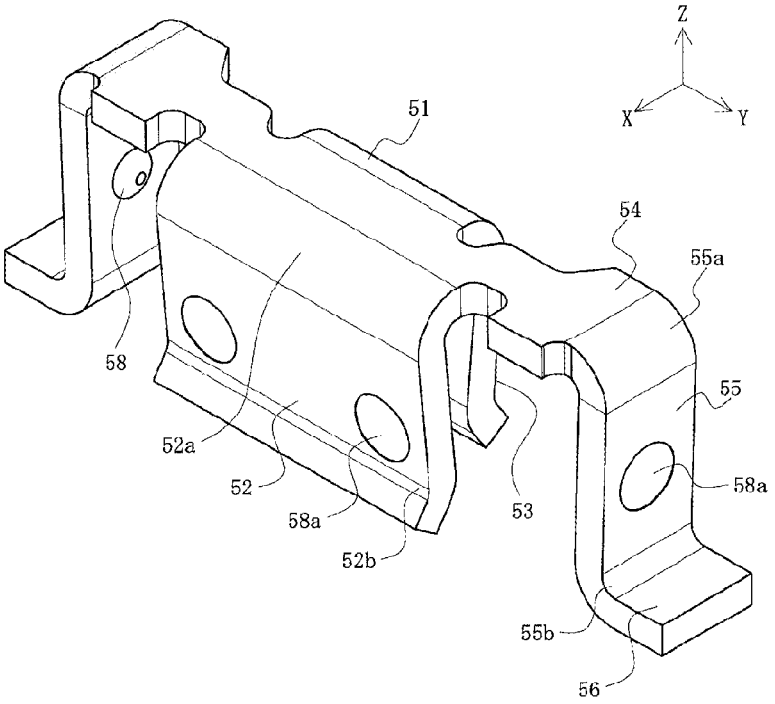
FIG. 13 is a perspective view of a first reinforcing bracket according to Embodiment 2.
Figures 14A, 14B, 14C:
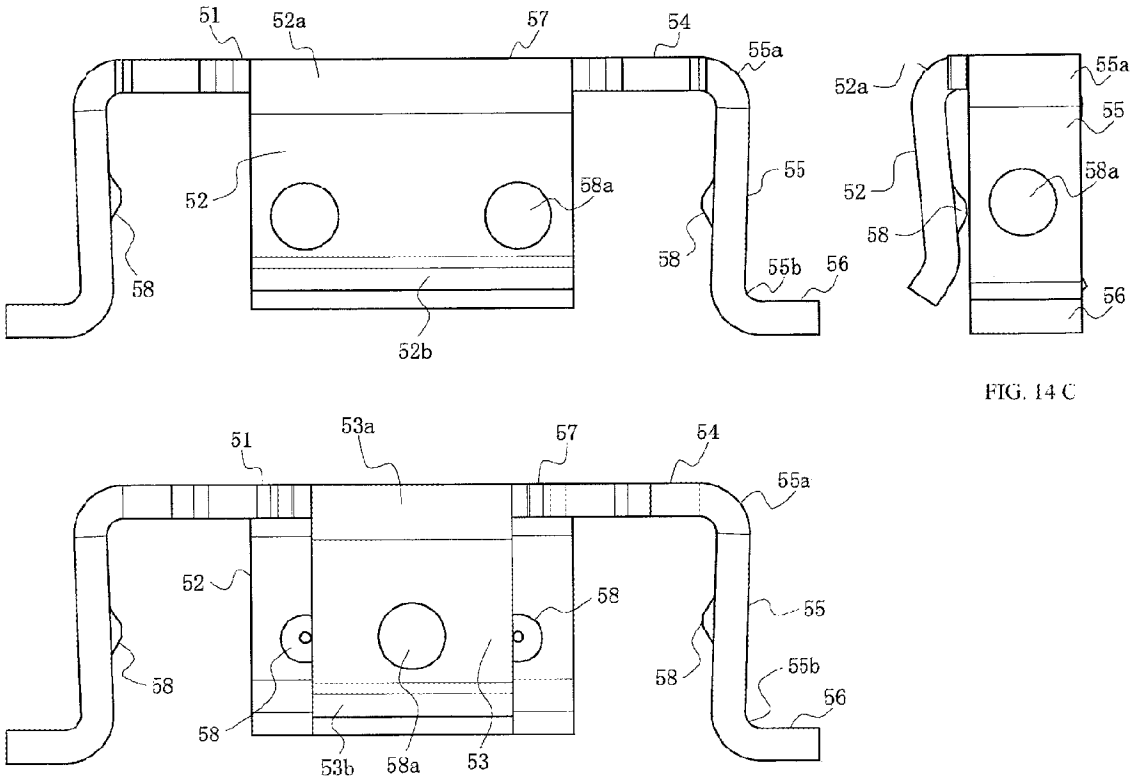
Figure 15A:
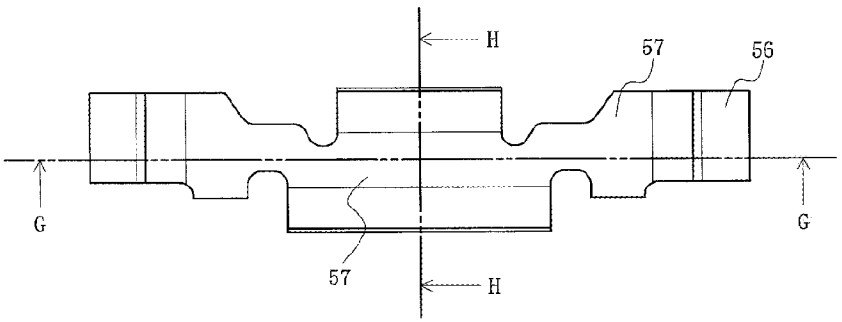
Figure 15B:
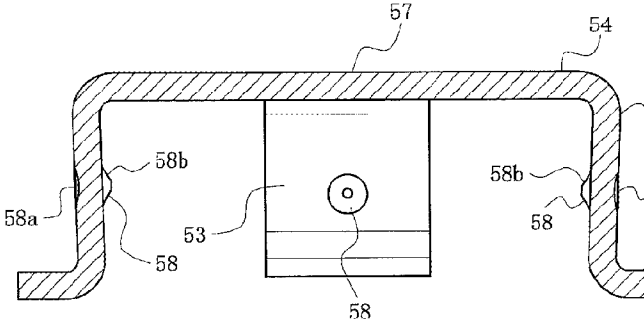
Figure 15C:
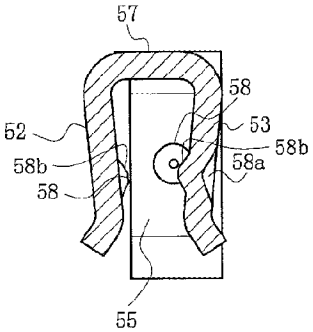
Figure 16:
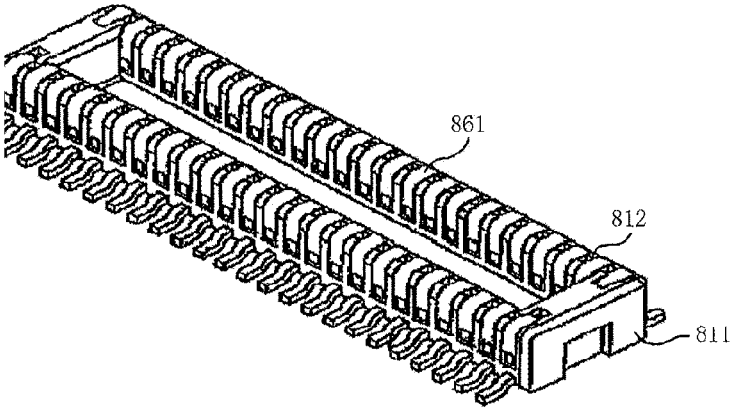
FIG. 16 Prior art
FIG. 16 is a perspective view illustrating a conventional connector.

FIG. 13 is a perspective view of a first reinforcing bracket according to Embodiment 2, FIGS. 14A-14C are first three-face views of the first reinforcing bracket according to Embodiment 2, and FIGS. 15A-15C are second three-face views of the first reinforcing bracket according to Embodiment 2. Note that in FIGS. 14A-14C, FIG. 14A is a front view, FIG. 14B is a rear view, and FIG. 14C is a side view, while in FIGS. 15A-15C, FIG. 15A is top view, FIG. 15B is a cross sectional view in the arrow direction along line G-G in FIG. 15A, and FIG. 15C is a cross sectional view in the arrow direction along line H-H in FIG. 15A.

The first reinforcing bracket 51 in the present embodiment includes a hemispherical protrusion 58 as a locking protrusion formed in the end wall outer surface covering part 52, the end wall inner surface covering part 53, and the leg part 55. Upon completion of the installation of the first reinforcing bracket 51 on the first protruding end part 18, this protrusion 58 is formed so as to engage with the step between the outer projection surface 15*b*1 and the outer recessed surface 15*b*2 of the end wall part 15, the step between the inner projection surface 15*c*1 and the inner recessed surface 15*c*2 of the end wall part 15, and the step between the outer projection surface 14*b*1 and the outer recessed surface 14*b*2 of the extension end part 14. Therefore, when the first reinforcing bracket 51 is raised relative to the end wall part 15 and removed, the protrusion 58 engages with the step, causing difficulty removing it. That is, the function of preventing the first reinforcing bracket 51 from coming off is exerted.

The protrusion 58 is a part formed by swelling a portion of a metal plate (which configures the end wall outer surface covering part 52, the end wall inner surface covering part 53, and the leg part 55) via processing such as pressing, with the protrusion 58 formed so as to hemispherically protrude from the surface inside the end wall outer surface covering part 52, the end wall inner surface covering part 53, and the leg part 55. Note that the protrusion 58 is formed on the surfaces outside the end wall outer surface covering part 52, the end wall inner surface covering part 53, and the leg part 55 by swelling the metal plate, with a recess 58*a* consequently formed at the position corresponding to each protrusion 58.

While the protrusion 58 is formed at least one location of each of the end wall outer surface covering part 52, the end wall inner surface covering part 53, and the leg part 55, it may be formed at two locations or more as required. Moreover, the position of the protrusion 58 in the vertical direction (Z-axis direction) is preferably a position at which a surface 58*b* on the upper side of the protrusion 58 abuts the step, upon completion of the installation of the first reinforcing bracket 51 to the first protruding end part 18.

In this manner, in the present embodiment, the first reinforcing bracket 51 includes the protrusion 58 formed in the end wall outer surface covering part 52, the end wall inner surface covering part 53, and the leg part 55, with the protrusion 58 engaging with the step. As a result, even if an upward external force is applied to the first reinforcing bracket 51 installed at the first protruding end part 18, the protrusion 58 engages with the steps contained in the outer surface 15*b* and the inner surface 15*c* of the end wall part 15 along with the outer surface 14*b* of the extension end part 14, causing difficulty in removing the first reinforcing bracket 51. Therefore, the first reinforcing bracket 51 is more assuredly prevented from coming off.

Note that the disclosure of the present specification describes characteristics related to a preferred and exemplary embodiment. Various other embodiments, modifications and variations within the scope and spirit of the claims appended hereto could naturally be conceived of by persons skilled in the art by summarizing the disclosures of the present specification. For example, the staggered arrangement of the terminals does not have to be systematic. In addition, the arrangement of the terminals on the left and right half body parts does not need to be the same. Furthermore, the left and right half body parts do not need to be axially symmetric.

The present disclosure can be applied to connectors.

What is claimed is:

1. A connector, comprising:

a pair of left and right half body parts, each of which includes a connector main body along with multiple terminals installed in the connector main body; and a reinforcing bracket for coupling the half body parts, wherein connector main bodies of each of the half body parts have main body end parts fixated on both ends thereof, wherein each connector main body extends in the longitudinal direction thereof, in addition to including a projection for retaining the terminals, an extension end part connected to both ends in the longitudinal direction of the projection, and an end wall part extending from the extension end part towards the counterpart half body part, and wherein each of the main body end parts include mutually facing left and right end wall parts along with left and right extension end parts with the end wall parts extending therefrom, wherein the reinforcing bracket includes: an upper plate extending in the width direction of the connector main body; and a pair of end wall plates which are connected to both side edges of the upper plate so as to cover the end wall part.

2. The connector according to claim 1, wherein the upper plate includes: an end wall upper surface covering part facing the upper surface of the end wall part; and a protruding end upper surface covering part which is connected to both ends of the end wall upper surface covering part so as to face the upper surface of the extension end part, while the end wall plate includes an end wall outer surface covering part and an end wall inner surface covering part which face the outer and inner surfaces of the end wall part.

3. A connector pair, comprising: the connector according to claim 1; and a counterpart connector mating with the connector.

4. A connector, comprising:

a pair of left and right half body parts, each of which includes a connector main body along with multiple terminals installed in the connector main body; and a reinforcing bracket for coupling the half body parts, wherein connector main bodies of each of the half body parts have main body end parts formed on both ends thereof, wherein each connector main body extends in the longitudinal direction thereof, in addition to including a projection for retaining the terminals, an extension end part connected to both ends in the longitudinal direction of the projection, and an end wall part extending from the extension end part towards the counterpart half body part, wherein each of the main body end parts include mutually facing left and right end wall parts along with left and right extension end parts with the end wall parts extending therefrom, wherein the reinforcing bracket includes: an upper plate extending in the width direction of the connector main body; and a pair of end wall plates which are connected to both side edges of the upper plate so as to cover the end wall part, wherein the end wall part includes a thick part along with a thin part connected to the lower side of the thick part, while the extension end part includes a thick part along with a thin part connected to the lower side of the thick part, and wherein, in the reinforcing bracket prior to the installation thereof to the main body end parts, the interval between the nearest parts of the end wall plates is narrower than the interval between the outer and inner surfaces at the location corresponding to the thick part of the end wall part, while the interval between the nearest parts of the extension end plates is narrower than the interval between the outer surfaces at the location corresponding to the thick part of the extension end part.

5. The connector according to claim 4, wherein the outer surface of the end wall part includes a step between an outer projection surface corresponding to the thick part and an outer recessed surface corresponding to the thin part, the inner surface of the end wall part includes a step between an inner projection surface corresponding to the thick part and an inner recessed surface corresponding to the thin part, and the outer surface of the extension end part includes a step between the outer projection surface corresponding to the thick part and the outer recessed surface corresponding to the thin part.

6. The connector according to claim 5, wherein the reinforcing bracket has a locking protrusion, which is formed in the end wall outer surface covering part, and the end wall inner surface covering part, and engages with the step.

7. A connector, comprising:

a pair of left and right half body parts, each of which includes a connector main body along with multiple terminals installed in the connector main body; and a reinforcing bracket for coupling the half body parts, wherein connector main bodies of each of the half body parts have main body end parts formed on both ends thereof, wherein each connector main body extends in the longitudinal direction thereof, in addition to including a projection for retaining the terminals, an extension end part connected to both ends in the longitudinal direction of the projection, and an end wall part extending from the extension end part towards the counterpart half body part, wherein each of the main body end parts include mutually facing left and right end wall parts along with left and right extension end parts with the end wall parts extending therefrom, wherein the reinforcing bracket includes: an upper plate extending in the width direction of the connector main body; and a pair of end wall plates which are connected to both side edges of the upper plate so as to cover the end wall part, wherein the upper surface of the end wall part and the upper surface of the extension end part are recessed from the upper surface of the projection, the outer surface of the end wall part is recessed from the end surface of the extension end part, the inner surface of the end wall part is recessed from an end wall base inner surface, the outer surface of the extension end part is recessed from the outer surface of the projection, the upper plate does not protrude from the upper surface of the projection, and the end wall plate does not protrude from an exposed side face of the main body end part.

8. A connector comprising:

a first body part having a first main body and first and second end body parts, the first main body extending in a longitudinal direction and extending from a first end thereof to a second end thereof, the first end body part having a first extension end part and a first end wall part, the first extension end part extending from the first end of the first main body in the longitudinal direction, the second end body part having a second extension end part and a second end wall part, the second extension end part extending from the second end of the first main body in the longitudinal direction;

a second body part having a second main body and third and fourth end body parts, the second main body extending in the longitudinal direction and extending from a first end thereof to a second end thereof, the third end body part having a third extension end part and a third end wall part, the third extension end part extending from the first end of the second main body in the longitudinal direction, the fourth end body part having a fourth extension end part and a fourth end wall part, the fourth extension end part extending from the second end of the second main body in the longitudinal direction;

at least one first terminal which is operatively associated with the first main body of the first body part;

at least one second terminal which is operatively associated with the second main body of the second body part;

a first reinforcing bracket; and a second reinforcing bracket, wherein the first reinforcing bracket engages with each of the first and third end body parts, thereby coupling the first and second body parts together, and wherein the second reinforcing bracket engages with each of the second and fourth end body parts, thereby coupling the first and second body parts together.

9. The connector according to claim 8, wherein the first end wall part extends from the first extension end part in a lateral direction to a first surface, wherein the second end wall part extends from the second extension end part in the lateral direction to a second surface, wherein the third end wall part extends from the third extension end part in the lateral direction to a third surface, wherein the fourth end wall part extends from the fourth extension end part in the lateral direction to a fourth surface, wherein, when the first reinforcing bracket engages with each of the first and third end body parts, the first and third surfaces face each other, and wherein, when the second reinforcing bracket engages with each of the second and fourth end body parts, the second and fourth surfaces face each other.

10. The connector according to claim 9, wherein, when the first reinforcing bracket engages with each of the first and third end body parts, the first and third surfaces abut each other, and wherein, when the second reinforcing bracket engages with each of the second and fourth end body parts, the second and fourth surfaces abut each other.

11. The connector according to claim 9, wherein the first reinforcing bracket has an end wall outer surface covering part which extends in the lateral direction from a first edge thereof to a second edge thereof, wherein the first and third surfaces are laterally positioned between the first and second edges of the end wall outer surface covering part of the first reinforcing bracket.

12. The connector according to claim 11, wherein the second reinforcing bracket has an end wall outer surface covering part which extends in the lateral direction from a first edge thereof to a second edge thereof, wherein the second and fourth surfaces are laterally positioned between the first and second edges of the end wall outer surface covering part of the second reinforcing bracket.

13. The connector according to claim 9, wherein the first reinforcing bracket has an end wall inner surface covering part which extends in the lateral direction from a first edge thereof to a second edge thereof, wherein the first and third surfaces are laterally positioned between the first and second edges of the end wall inner surface covering part of the first reinforcing bracket.

14. The connector according to claim 13, wherein the second reinforcing bracket has an end wall inner surface covering part which extends in the lateral direction from a first edge thereof to a second edge thereof, wherein the second and fourth surfaces are laterally positioned between the first and second edges of the end wall inner surface covering part of the second reinforcing bracket.

15. The connector according to claim 9, wherein the first reinforcing bracket has an end wall outer surface covering part which extends in the lateral direction from a first edge thereof to a second edge thereof, wherein the first and third surfaces are laterally positioned between the first and second edges of the end wall outer surface covering part of the first reinforcing bracket, wherein the first reinforcing bracket has an end wall inner surface covering part which extends in the lateral direction from a first edge thereof to a second edge thereof, wherein the first and third surfaces are laterally positioned between the first and second edges of the end wall inner surface covering part of the first reinforcing bracket, and wherein the first and third surfaces are longitudinally positioned between the end wall outer surface covering part of the first reinforcing bracket and the end wall inner surface covering part of the first reinforcing bracket.

16. The connector according to claim 15, wherein the first reinforcing bracket has an end wall upper surface covering part which connects the end wall outer surface covering part of the first reinforcing bracket to the end wall inner surface covering part of the first reinforcing bracket.

17. The connector according to claim 15, wherein the end wall outer surface covering part of the first reinforcing bracket and the end wall inner surface covering part of the first reinforcing bracket are not connected to each other in the longitudinal direction between the first and third surfaces.

18. The connector according to claim 15, wherein the second reinforcing bracket has an end wall outer surface covering part which extends in the lateral direction from a first edge thereof to a second edge thereof, wherein the second and fourth surfaces are laterally positioned between the first and second edges of the end wall outer surface covering part of the second reinforcing bracket, wherein the second reinforcing bracket has an end wall inner surface covering part which extends in the lateral direction from a first edge thereof to a second edge thereof, wherein the second and fourth surfaces are laterally positioned between the first and second edges of the end wall inner surface covering part of the second reinforcing bracket, and wherein the second and fourth surfaces are longitudinally positioned between the end wall outer surface covering part of the second reinforcing bracket and the end wall inner surface covering part of the second reinforcing bracket.

19. The connector according to claim 18, wherein the second reinforcing bracket has an end wall upper surface covering part which connects the end wall outer surface covering part of the second reinforcing bracket to the end wall inner surface covering part of the second reinforcing bracket.

20. The connector according to claim 18, wherein the end wall outer surface covering part of the second reinforcing bracket and the end wall inner surface covering part of the second reinforcing bracket are not connected to each other in the longitudinal direction between the second and fourth surfaces.

21. A connector pair, comprising: the connector according to claim 8; and a counterpart connector mating with the connector.

* * * * *